US010864524B2

(12) United States Patent
Koenig et al.

(10) Patent No.: US 10,864,524 B2
(45) Date of Patent: Dec. 15, 2020

(54) DUAL AUGER SHREDDER HAVING LOW PROFILE

(71) Applicants: Mark E. Koenig, Pickerington, OH (US); Larry E. Koenig, Canal Winchester, OH (US)

(72) Inventors: Mark E. Koenig, Pickerington, OH (US); Larry E. Koenig, Canal Winchester, OH (US)

( * ) Notice: Subject to any disclaimer, the term of this patent is extended or adjusted under 35 U.S.C. 154(b) by 833 days.

(21) Appl. No.: 14/558,497

(22) Filed: Dec. 2, 2014

(65) Prior Publication Data

US 2015/0202632 A1 Jul. 23, 2015

Related U.S. Application Data

(60) Provisional application No. 61/910,893, filed on Dec. 2, 2013.

(51) Int. Cl.

| | |
|---|---|
| ***B02C 19/22*** | (2006.01) |
| ***B02C 23/02*** | (2006.01) |
| ***B30B 11/24*** | (2006.01) |
| ***B02C 18/14*** | (2006.01) |
| ***B02C 18/00*** | (2006.01) |

(52) U.S. Cl.

CPC ..... *B02C 19/22* (2013.01); *B02C 18/0084* (2013.01); *B02C 18/142* (2013.01); *B02C 23/02* (2013.01); *B30B 11/243* (2013.01); *B02C 2201/06* (2013.01)

(58) Field of Classification Search

CPC ..... B02C 19/22; B02C 18/0084; B02C 4/10; B02C 2201/06; B02C 18/142; B02C 23/02; B30B 11/243; B30B 9/16

USPC ..... 241/235, 260.1, 223, 224, 101.74, 248; 100/146

See application file for complete search history.

(56) References Cited

U.S. PATENT DOCUMENTS 3,771,531 A * 11/1973 Scribner ..... A01D 45/22 414/346
3,897,882 A * 8/1975 Budoff ..... B60P 1/6427 414/500

(Continued)

OTHER PUBLICATIONS

Environmental Industry Associations, American National Standard for Equipment Technology and Operations for Wastes and Recyclable Materials, Jan. 15, 2008, 44 pages.

(Continued)

*Primary Examiner* — Shelley M Self
*Assistant Examiner* — Smith Oberto Bapthelus
(74) *Attorney, Agent, or Firm* — Standley Law Group LLP; Jeffrey C. Norris; Eric M. Gayan

(57) ABSTRACT

An auger system adapted to shred large materials. An exemplary embodiment is comprised of dual opposing augers that are adapted to grab, compress, and shred the material, reducing the material size such that it may be discharged through a side outlet opening and/or an extrusion tube into, for example, a standard roll-off compaction container. An exemplary embodiment allows large material to be processed in a low speed device with reduced equipment dimensions, providing operator safety with low profile loading, lower noise level, reduced chances of material being expelled from the processing chamber, and ability to use conventional material transport (e.g., semi-trucks).

36 Claims, 31 Drawing Sheets

(56) References Cited

U.S. PATENT DOCUMENTS 4,040,571 A * 8/1977 Lindeborg ..... B02C 19/22 241/135
4,253,615 A * 3/1981 Koenig ..... B02C 19/22 241/260.1
4,632,317 A * 12/1986 Wexell ..... B02C 19/22 241/101.74
4,915,308 A * 4/1990 Koenig ..... B02C 19/22 241/161
4,938,426 A * 7/1990 Koenig ..... B02C 18/0084 241/222
4,951,884 A * 8/1990 Koenig ..... B02C 19/22 198/672
4,961,539 A * 10/1990 Deem ..... B02C 21/02 241/101.741
4,993,649 A * 2/1991 Koenig ..... B02C 19/22 241/224
5,022,328 A * 6/1991 Robertson ..... F23G 5/033 110/101 R
5,108,040 A * 4/1992 Koenig ..... B30B 11/246 241/260.1
5,205,495 A * 4/1993 Garnier ..... B02C 18/0084 241/159
5,217,173 A * 6/1993 Koenig ..... F23G 5/448 110/232
5,351,899 A * 10/1994 Koenig ..... B02C 19/22 241/260.1
5,462,238 A * 10/1995 Smith ..... B02C 18/145 241/243
5,479,728 A * 1/1996 Deken ..... E02F 5/226 172/155
5,481,851 A * 1/1996 Koenig ..... B65B 1/04 141/103
RE36,023 E * 1/1999 Koenig ..... B02C 19/22 100/145
6,092,753 A * 7/2000 Koenig ..... B02C 18/142 241/236
6,120,648 A * 9/2000 Scott ..... D21B 1/30 134/132
7,028,610 B1 * 4/2006 Ralicki ..... B02C 19/22 100/145
7,958,820 B2 * 6/2011 Duperon ..... B30B 9/121 100/117
2006/0032957 A1 * 2/2006 Kolbet ..... B02C 18/0007 241/101.74
2011/0168823 A1 * 7/2011 Rosen ..... B02C 4/286 241/222
2014/0339346 A1 * 11/2014 Koenig ..... B02C 23/02 241/101.5
2015/0202632 A1 * 7/2015 Koenig ..... B02C 18/0084 241/248

OTHER PUBLICATIONS

Komar Industries, photos from a video of the Exemplary Embodiment compacting a crate, 2018, https://vimeo.com/288545615/5112c56c15, 4 pages.
Exhibit B, Photo of known Dual Auger Shredder.
Exhibit C, Photo looking inside known Dual Auger Shredder.
Exhibit D, Photo of known Dual Auger Shredder inside warehouse.
Exhibit E, Photo of known Dual Auger Shredder outside warehouse.

* cited by examiner

DUAL AUGER SHREDDER HAVING LOW PROFILE

This application claims the benefit of U.S. Provisional Application No. 61/910,893, filed Dec. 2, 2013, which is hereby incorporated by reference in its entirety.

BACKGROUND AND SUMMARY OF THE INVENTION

Exemplary embodiments of the present invention relate generally to a multiple auger system adapted for shredding various types of materials (e.g., waste).

Examples of known shredder systems may require the material to be transported to an undesirably high location (e.g., 20 feet or higher) in order to be input to the shredder system. Moreover, known systems may have material delivery systems or procedures that need to be designed to transport the material to higher locations to allow for larger material loads to be input to the shredder system. As a result, such systems demand a significant amount of space to operate.

Oftentimes, the height of the shredder system is necessary to allow room for discharge of the shredded material from the bottom of the system. For example, the bottom or floor of some known shredder systems is configured to open up to allow the shredded material to exit. A conveyor or storage container, for instance, may be situated under the shredder system in order to transport the shredded material away. Consequently, these types of large scale shredder systems may reach undesirable heights for many applications.

On the other hand, some known systems may not be designed to be able shred larger loads (e.g., large crates, pallets, furniture, appliances, drums, telephone poles, railroad ties, etc.). For instance, some known system may not have sufficient size or screw characteristics. As a result, larger loads may need to be manually broken down in these instances, which is time and cost intensive.

Known shredder systems may also not be able to shred material at a desirable rate or to a desirable degree. For example, some shredder systems utilize one or more straight screws to shred the material. Such systems may not be able to efficiently shred large scale items.

A need also exists for improved breaking of bales. In addition, when breaking bales, there is a need to be able to meter the output of shredded material.

There is also a need for processing modes for dual auger machines having a side output. For instance, a need exists to be able to process the material in the processing chamber until there is a need for it and/or until it is suitably processed. This need is particularly relevant to bale breaking operations, but it also pertains to other types of shredding activities.

Exemplary embodiments may overcome some or all of the aforementioned disadvantages of the known art. One exemplary embodiment may provide a shredding system having a relatively low profile compared to known systems for shredding large scale items. One embodiment may eliminate the need to discharge the shredded material out of the bottom of the unit. For example, one embodiment is a dual screw auger system that has an outlet that is substantially in line with the axis of one of the augers that is cantilevered. Consequently, such an embodiment may be adapted to discharge the shredded material directly into a standard roll-off container or a semi-trailer, or onto a conveyor, without unnecessarily elevating the shredder system above the ground. An exemplary embodiment may also comprise at least one tapered auger screw to achieve a desired degree of shredding of large scale items at a desired rate. For instance, an exemplary embodiment may comprise twin opposing tapered augers, which may operate at slower speeds, with more torque, to more efficiently and safely shred large scale items as compared to known straight screw systems. Furthermore, exemplary embodiments may comprise fixed or variable speed drive(s). For example, the use of variable speed drives may facilitate metering of the output shredded material. Exemplary embodiments may also be adapted to adjust the rate and/or direction of rotation of each auger, either in unison or independently. An exemplary embodiment may also comprise an input mechanism associated with the processing chamber that facilitates the introduction of large scale items. One example may comprise a drop hopper wall of sufficient dimensions to receive and rotate large scale items (e.g., oversize crates) into the processing chamber. In such an embodiment, the drop hopper wall may be located at a significantly lower height as compared to known systems for shredding large scale items. Another embodiment may include an elongated hopper associated with the processing chamber, which facilitates the introduction of large scale items.

In addition to the novel features and advantages mentioned above, other benefits will be readily apparent from the following descriptions of the drawings and exemplary embodiments.

BRIEF DESCRIPTION OF THE DRAWINGS

FIG. 20 shows an exemplary embodiment comprising a container lockdown device. Other exemplary embodiments may comprise a manual or mechanical ratchet such as for engaging a container.

DETAILED DESCRIPTION OF EXEMPLARY EMBODIMENT(S)

Figure 1:
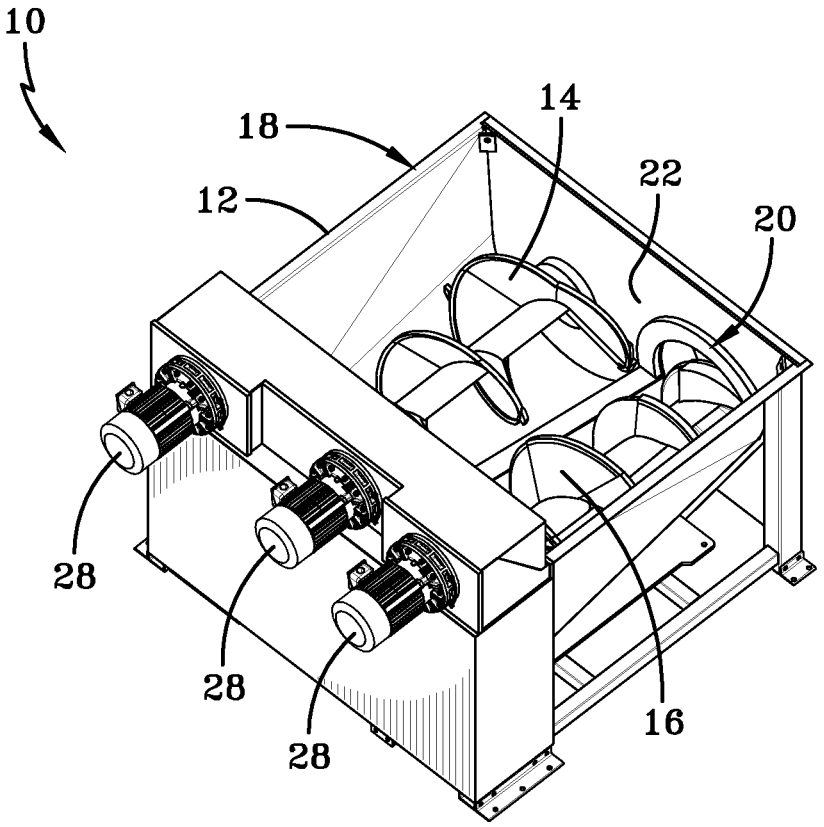
FIGS. 1-6 show various views of an exemplary embodiment of a shredder system of the present invention.
Figure 2:
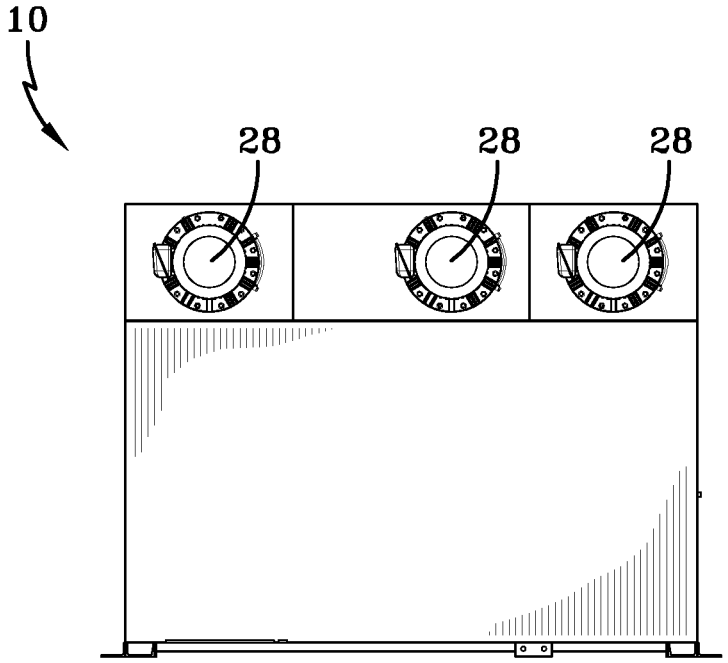
Figure 3:
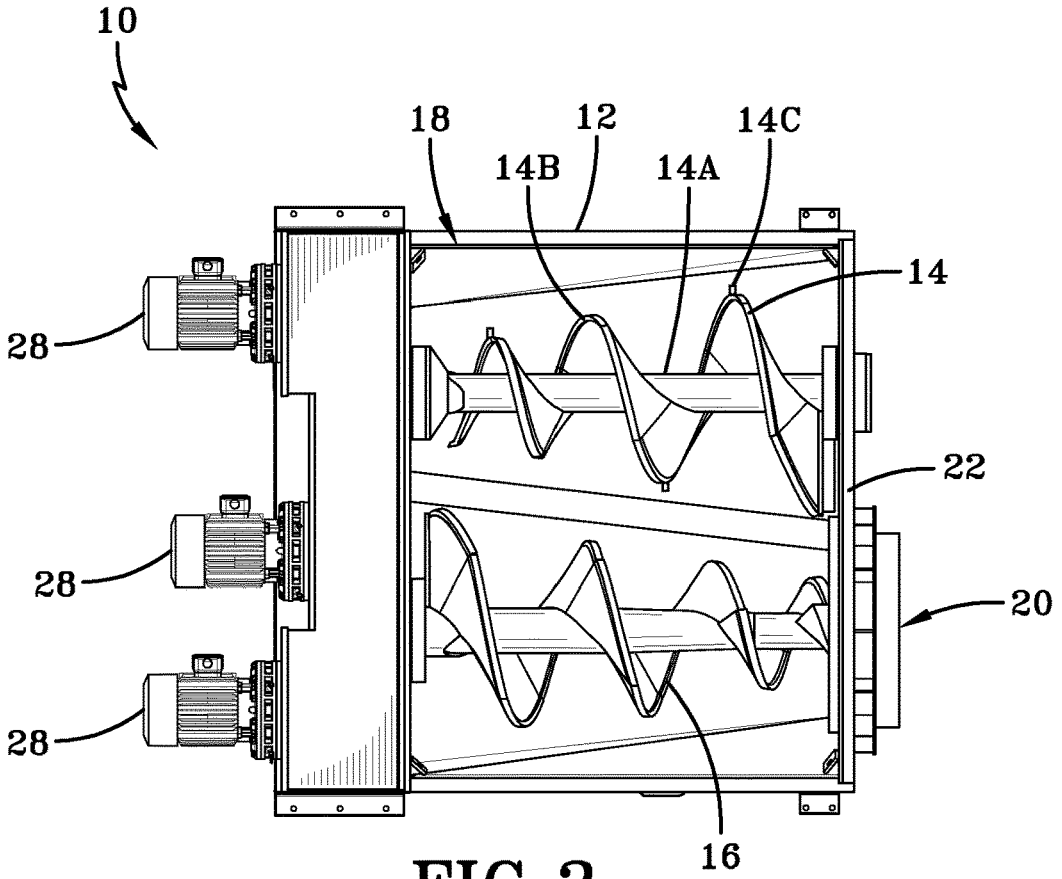

Exemplary embodiments of the present invention are directed to a shredder system and method for operation. Exemplary embodiments may be particularly beneficial for shredding large scale items such as oversize crates, pallets, furniture, appliances, drums, telephone poles, railroad ties, and other large scale items. However, it is not intended to limit the invention to the shredding of any particular type of material unless expressly set forth otherwise.

FIGS. 1-6 show various views of one exemplary embodiment of a shredder system. In this example, system 10 is comprised of a processing chamber 12 and twin opposing tapered augers 14 and 16, which are positioned in processing chamber 12. The processing chamber 12 may include an input opening 18 that is adapted to receive material to be shredded. The opposed combination of augers 14 and 16 may then shred the material. In particular, an exemplary embodiment of the opposing augers 14 and 16 may be particularly beneficial for shredding large scale items to a desirable degree at an efficient rate. In an exemplary embodiment, the material may primarily be shredded by the action between opposing augers 14 and 16. The shredded material may then be urged by auger 16 through a discharge opening 20 in a side 22 of processing chamber 12.

Figure 4:
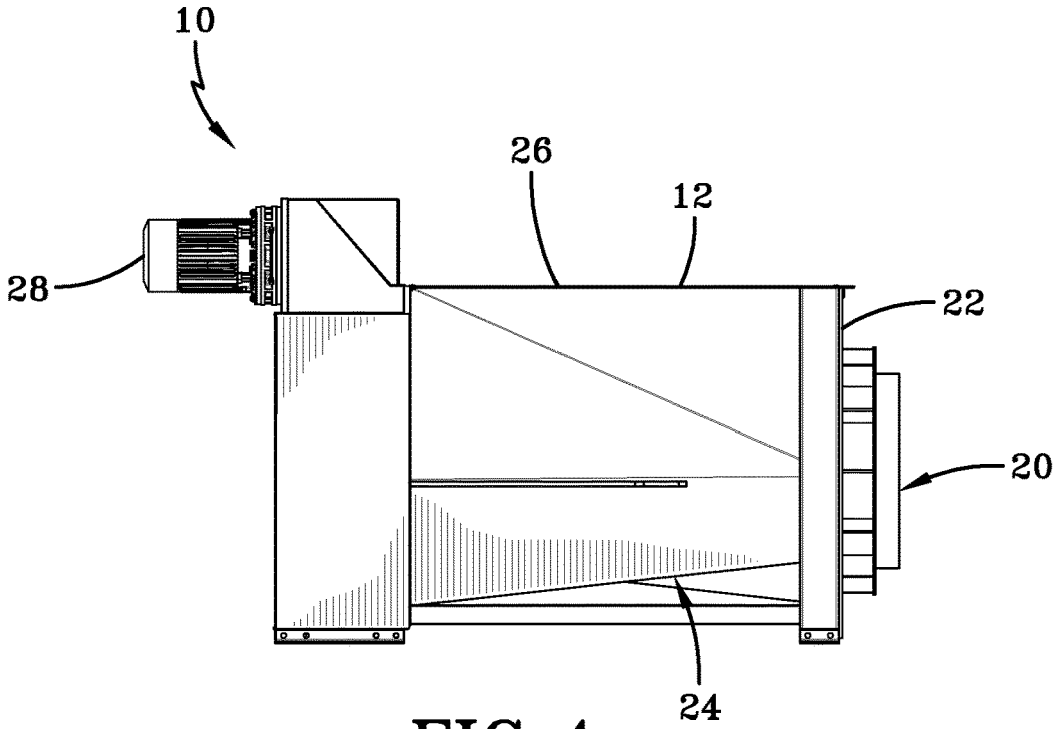
Figure 5:
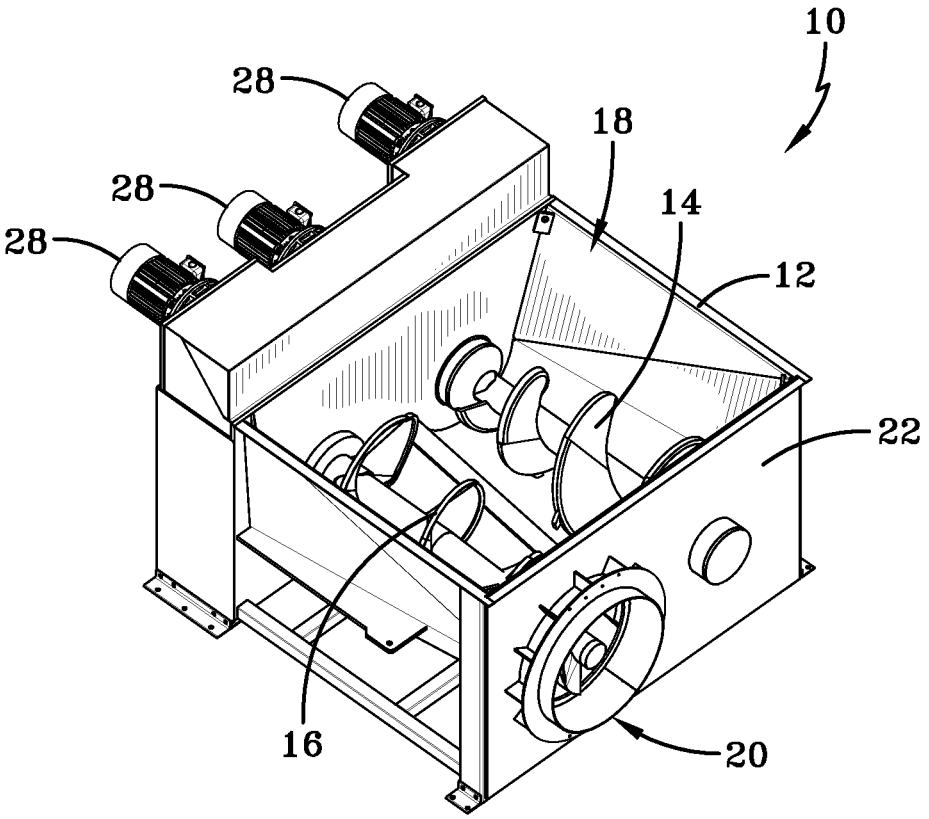

By not discharging the shredded material out of the bottom of the processing chamber 12 and instead locating discharge opening 20 in a side 22 such as in this embodiment, system 10 may have a low profile to facilitate loading of material and increase safety. In an exemplary embodiment, there is no need to elevate the processing chamber 12 a significant amount above the ground or floor. Such features may also facilitate the discharge of shredded material into conventional material transport (e.g., semi-trucks, rail cars, etc.). For example, such as shown in the embodiment of FIG. 4, a bottom 24 of processing chamber 12 may be located at or in close proximity to ground or floor level, particularly as compared to the known art for shredding large scale items. Likewise, a top 26 of processing chamber 12 may be located at a significantly lower height as compared to the known art for shredding large scale items. For instance, one example of processing chamber 12 may have a top of a processing chamber at a height of about 10 feet or less, more preferably about 7.5 feet or less, above the ground or floor. Nevertheless, other exemplary embodiments may have different profiles, configurations, or dimensions. For example, some exemplary embodiments may have multiple discharge openings and/or an opening or openings on multiple sides.

Opposing augers 14 and 16 may have similar or dissimilar physical characteristics. In this example, the physical features of augers 14 and 16 are similar. For the sake of simplicity, features of this embodiment of auger 14 are described with reference to FIG. 3. In this embodiment, auger 14 is comprised of a tapered shaft 14A and at least one tapered flight 14B that extends around shaft 14A. However, some embodiments of a tapered auger may include any combination of a tapered shaft and a tapered flight. In this exemplary embodiment, at least one tooth 14C extends from an edge of flight 14B. In other embodiments, at least one tooth may protrude from another portion of a flight, a shaft, or a processing chamber. One or more teeth may facilitate the grabbing of material and moving it into the shredding action. In an exemplary embodiment, at least one tooth may also mesh or associate with at least one breaker bar of a processing chamber to facilitate the grabbing and shredding of material. However, other exemplary embodiments may not utilize or benefit from teeth and/or breaker bars.

This exemplary embodiment particularly benefits from the use of dual opposing tapered augers. Nonetheless, some embodiments may only include one auger or screw, or three or more augers or screws. Further, the auger(s) or screw(s) of some embodiments may not be tapered. In this example, the shafts of the opposing augers are substantially parallel, which promotes shredding in a compact design. Nevertheless, some embodiments may have shafts that are not substantially parallel (e.g., embodiments that have augers that have dissimilar physical configurations).

Augers 14 and 16 may utilize any suitable drive and control system. The example of FIGS. 1-6 implements drives 28. In an exemplary embodiment, each auger may be powered by a respective drive 28. Examples of drives 28 include, but are not limited to, hydraulic and electric motors. Exemplary embodiments may also comprise fixed or variable speed drive(s). For example, the use of variable speed drives may facilitate metering of the output of shredded material. This may enable a desired and more consistent flow of shredded material out of the processing chamber.

FIGS. 7-10 show various views of another exemplary embodiment of a shredder system with hydraulic drives that may otherwise be similar to the embodiment shown in FIGS. 1-6. In particular, the embodiment of FIGS. 7-10 comprise hydraulic drives 30, wherein each auger is configured to be powered by a respective drive 30. Examples of hydraulic drives may comprise direct drive hydraulic motors (e.g., as shown in this embodiment), sprocket and chain drive assemblies, or other hydraulic drive mechanisms. In an exemplary embodiment, particular benefits of using hydraulic drives may further include: the ability to achieve high torque at low speeds, which facilitates the shredding of large materials and also helps to prevent or substantially limit the expelling of debris from the processing chamber; the ability to handle loads of heavier cross-section material; and the ability to withstand higher shock loads. As a result, exemplary embodiments comprising hydraulic drives may facilitate an efficient and safe process.

Exemplary embodiments may also be adapted to adjust the rate and/or direction of rotation of each auger, either in unison or independently. For example, in one mode of operation, primary auger 16 is adapted to rotate at a faster rate than auger 14 to facilitate a substantially continual discharge of suitably processed material from the processing chamber 12, while at the same time allowing for further circulation of material in the processing chamber 12 that has not yet been suitably processed. In another mode of operation (i.e., an agitation mode), each auger is adapted to alternately rotate in forward and reverse directions (either independently or unison) to continually process the material without, or substantially without, discharging it from the processing chamber. In an exemplary embodiment, by controlling and synchronizing the rate and direction of rotation of each auger (e.g., by repeating a sequence of grinding the material between the augers and then reversing the direction of rotation of each auger), desired agitation of the material in the processing chamber may be achieved. Such control modes or sequences are believed to be novel and unique ways to process material in a dual auger system having a side output such that material is either discharged from the processing chamber or retained therein (e.g., for agitation) without having to shut down the system.

Figure 6:
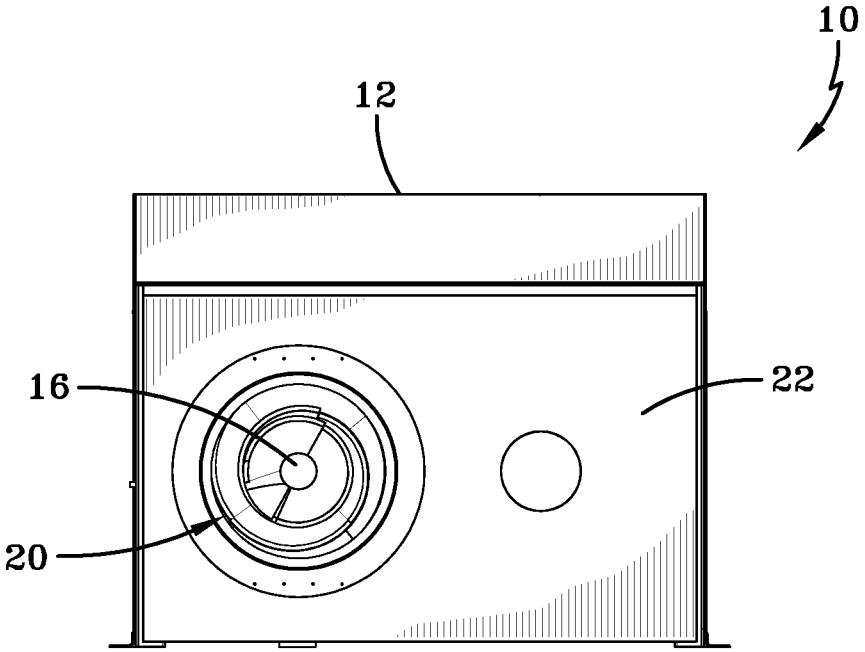
Figure 7:
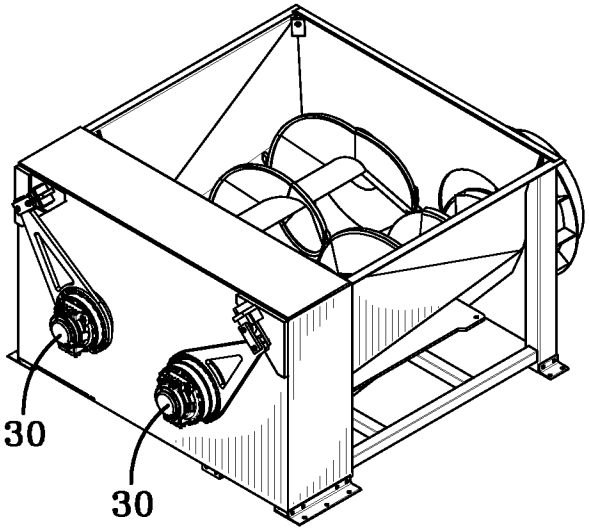
FIG. 7-9 show various views of an exemplary embodiment of a shredder system of the present invention, which comprises hydraulic drives.
Figure 9:
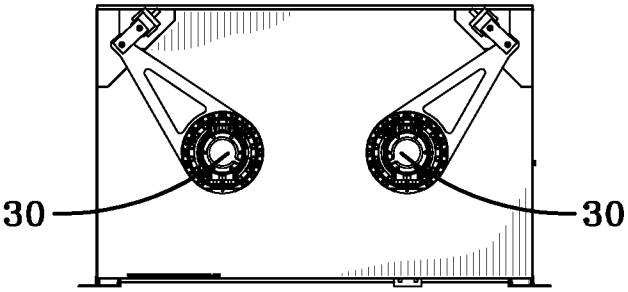
Figure 8:
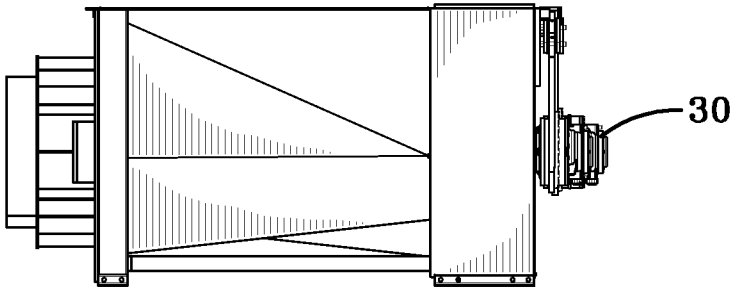
Figure 10:
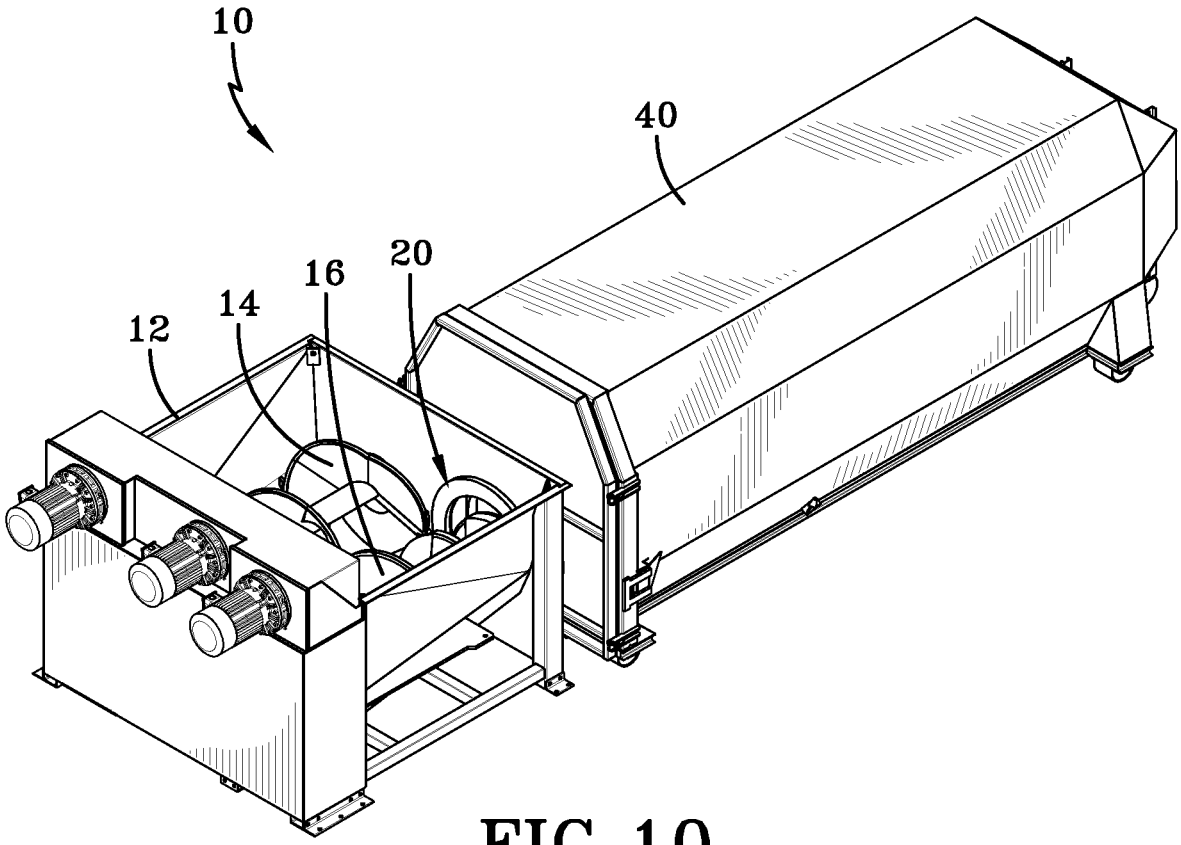
FIGS. 10-15 show various views of the shredder system of FIGS. 1-6 connected to an example of a standard roll-off container.
Figure 11:
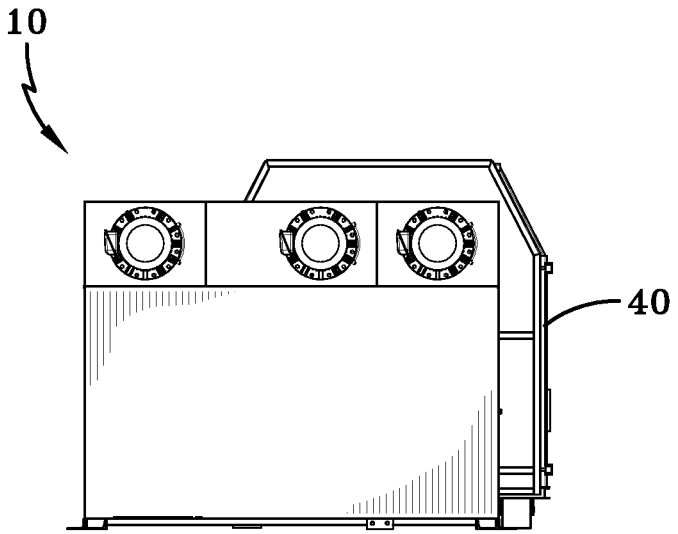
Figure 12:
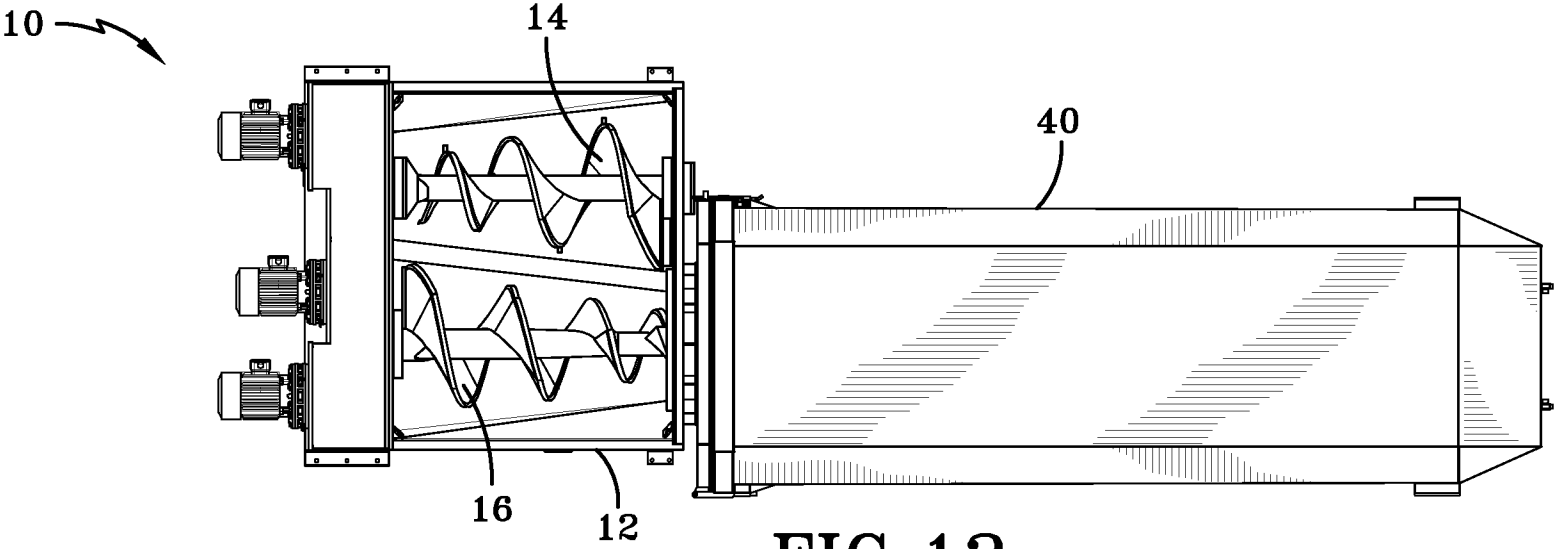
Figure 13:
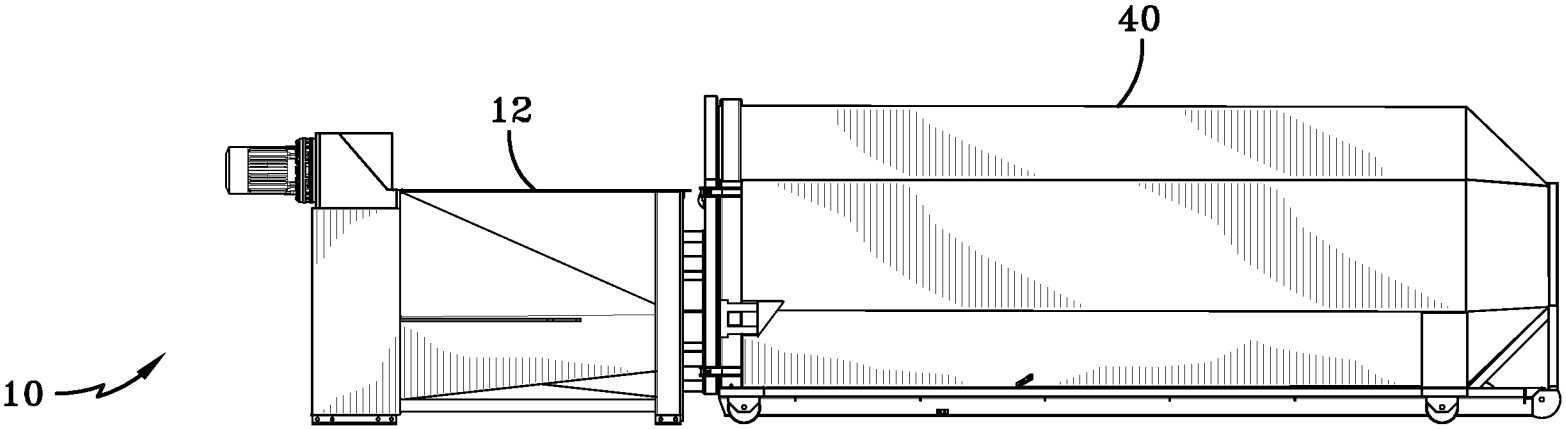
Figure 14:
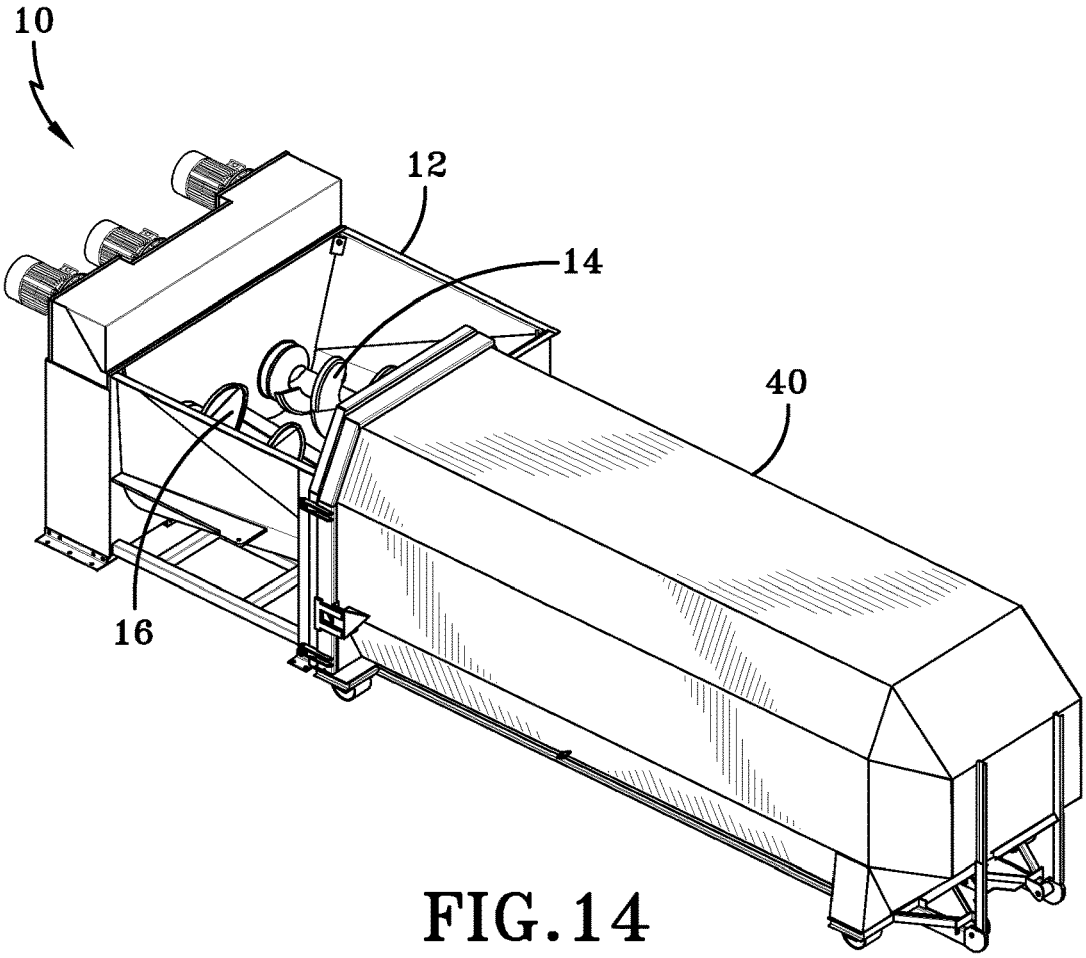
Figure 15:
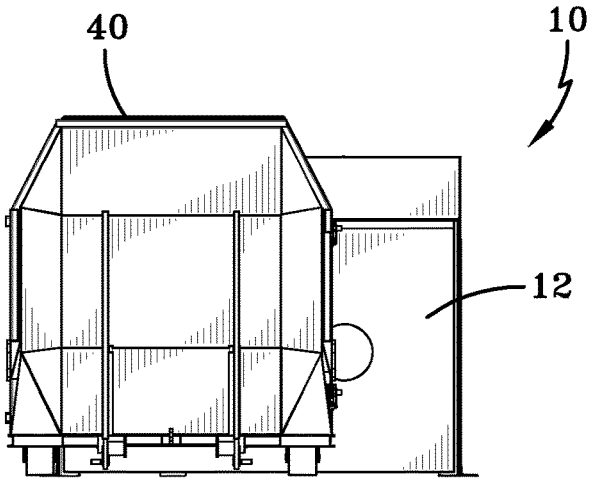
Figure 16:
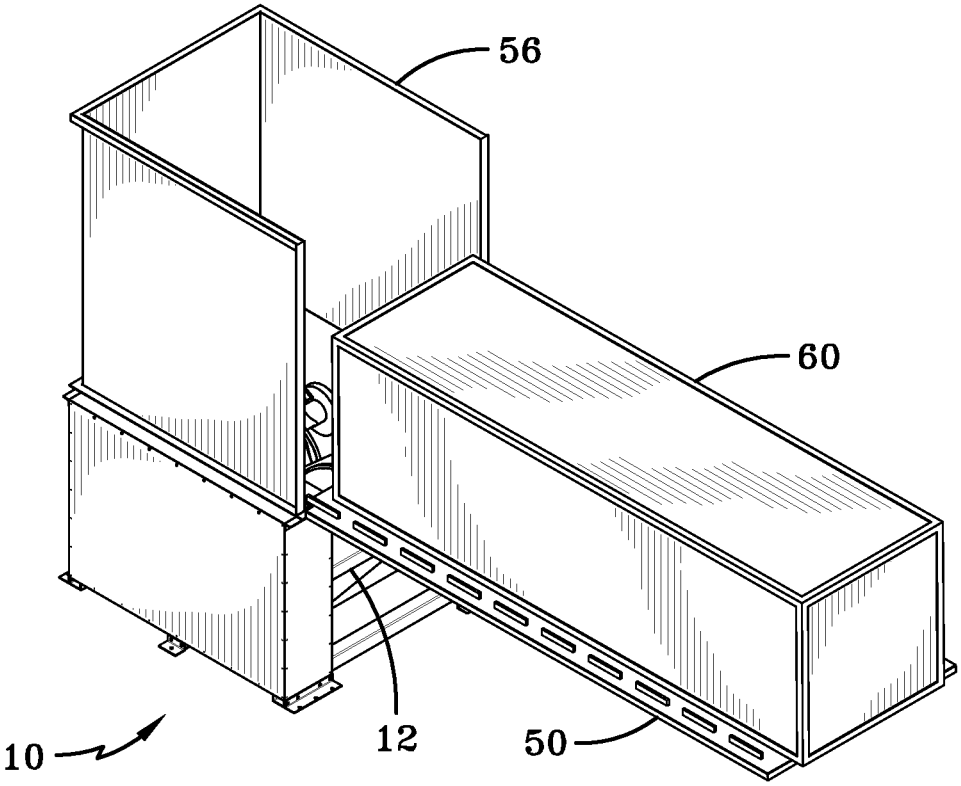
FIGS. 16-21 show various views of a second exemplary embodiment of a shredder system of the present invention.
Figure 17:
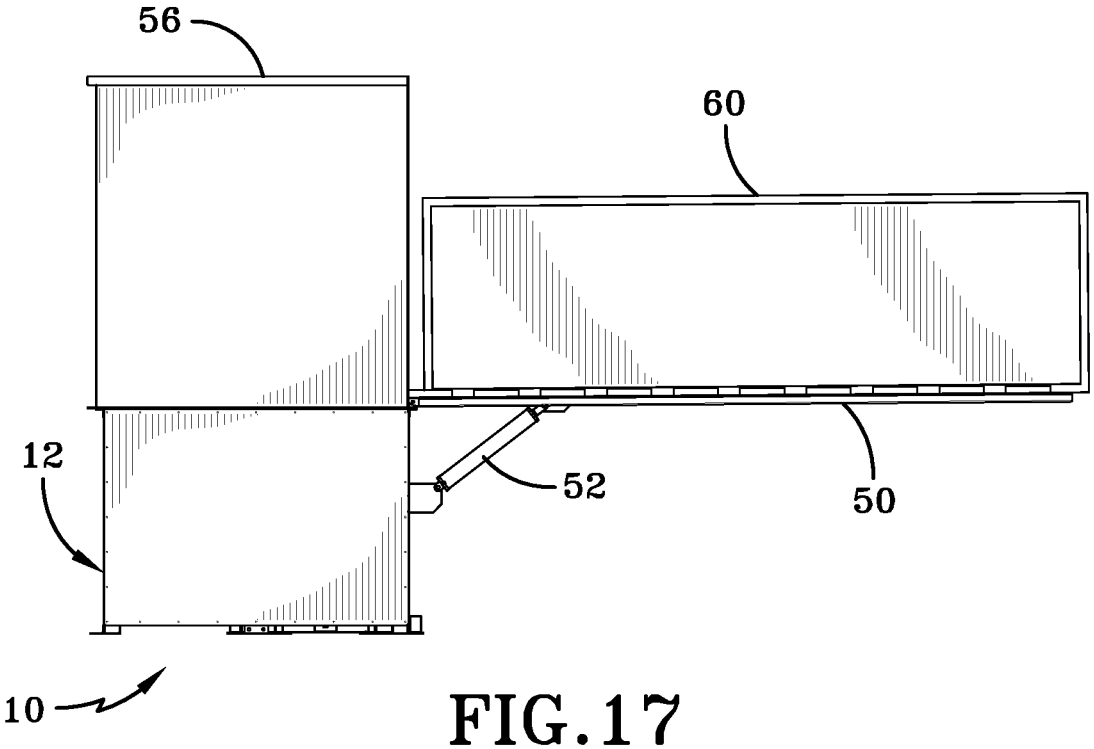
Figure 18:
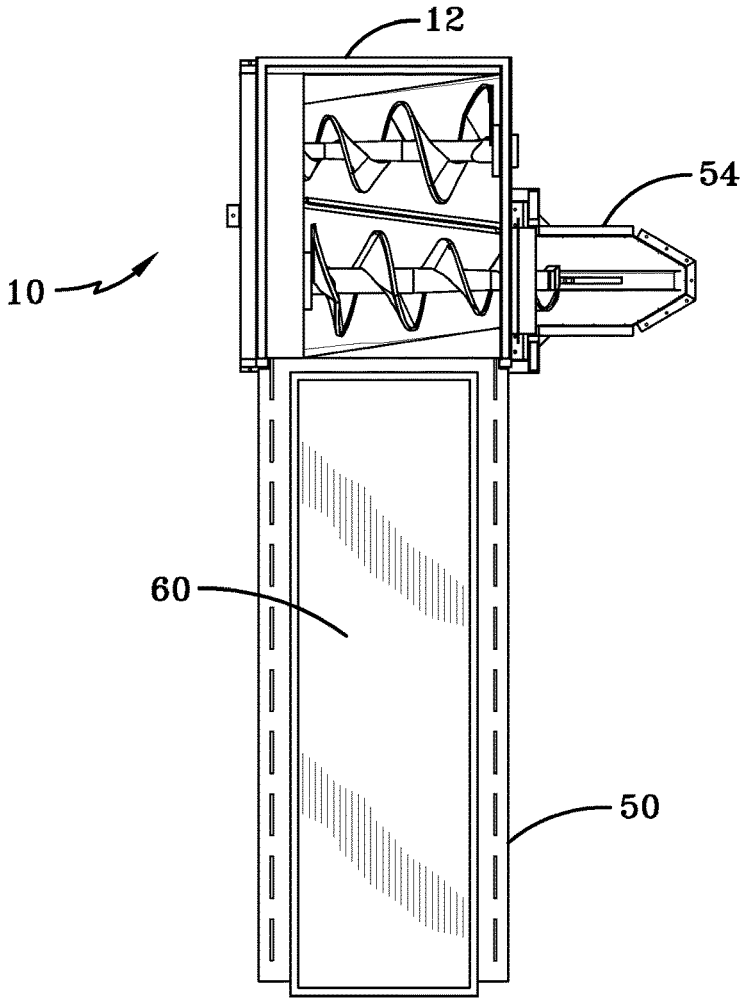
Figure 19:
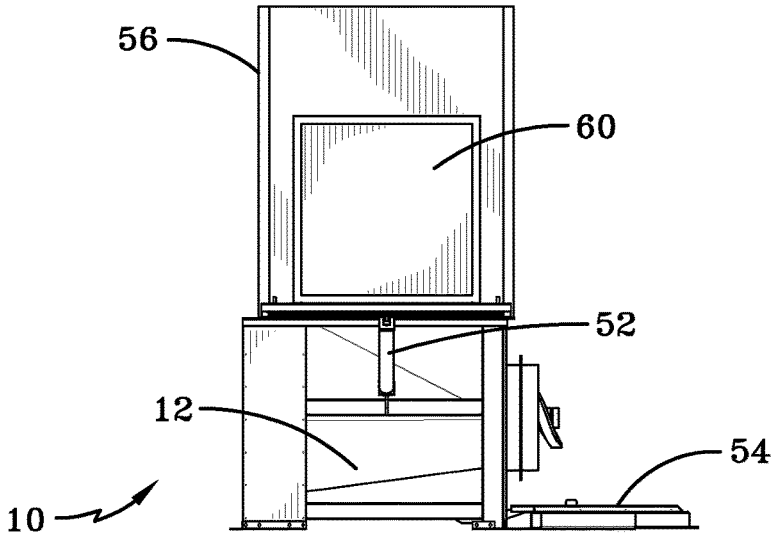
Figure 20:
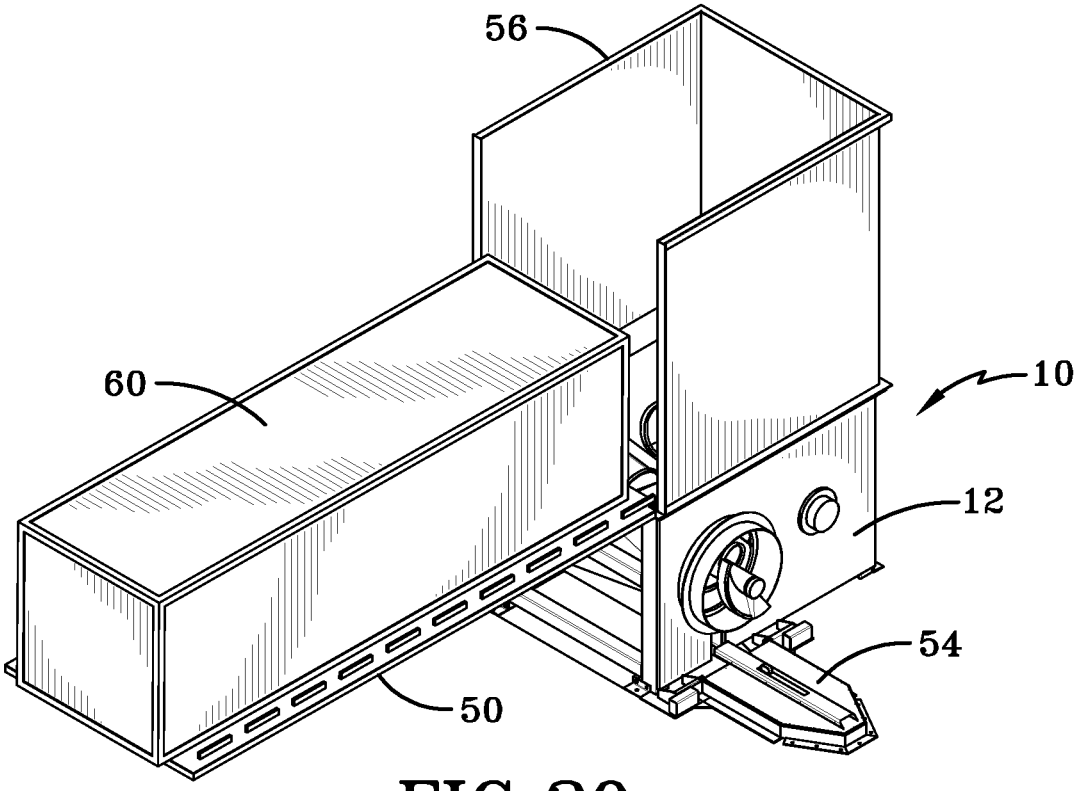
Figure 21:
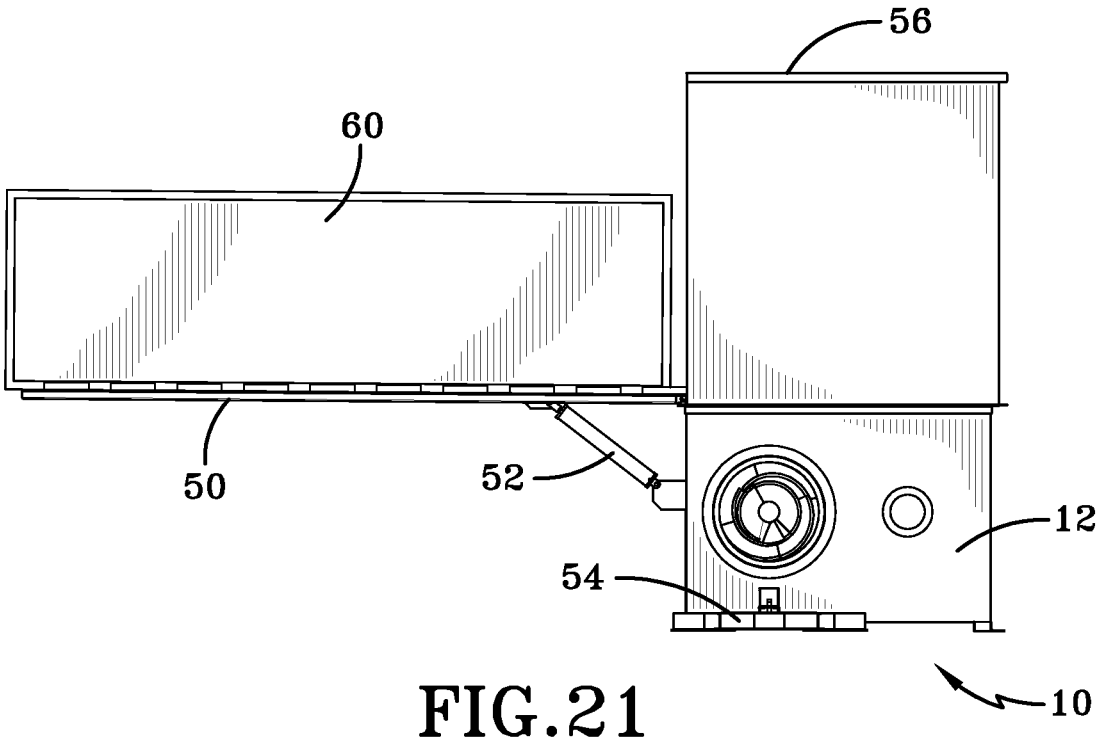
Figure 22:
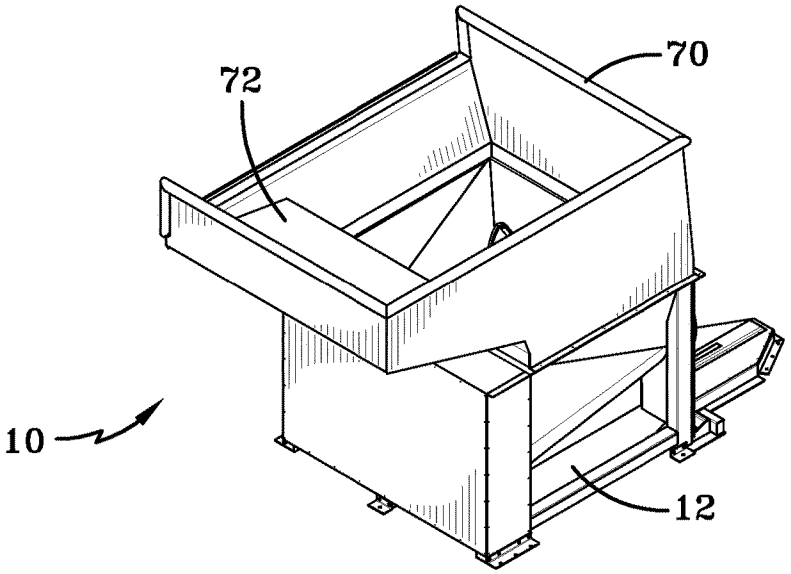
FIGS. 22-28 show various views of a third exemplary embodiment of a shredder system of the present invention. Dimensions are provided for purposes of example.
Figure 24:
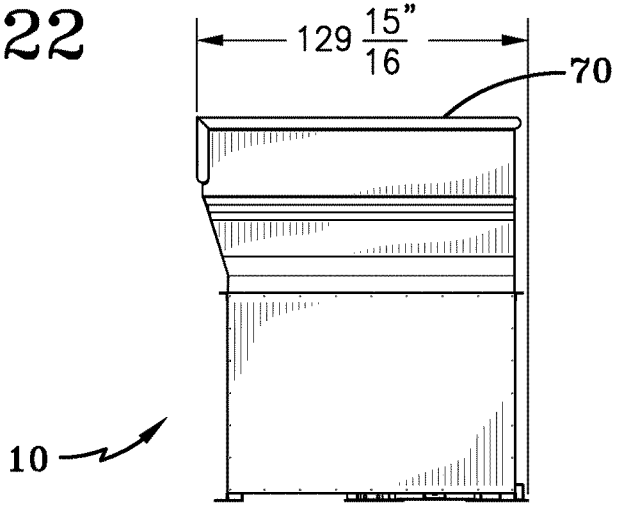
Figure 23:
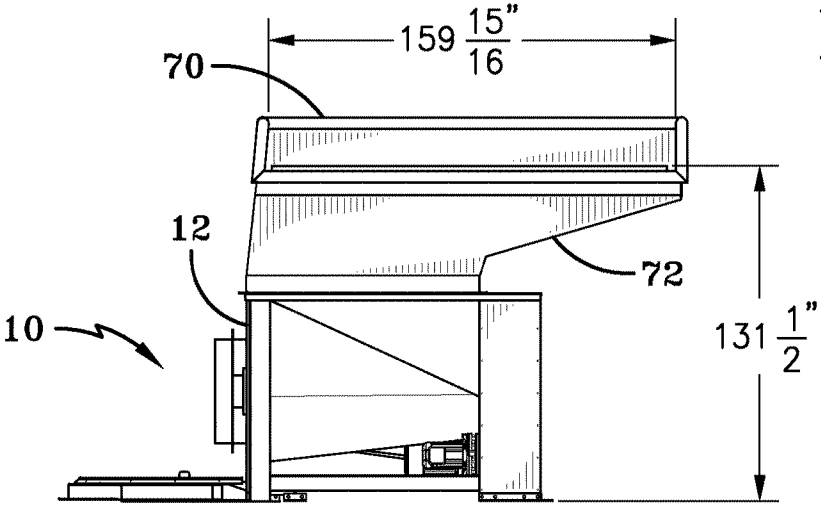
Figure 25:
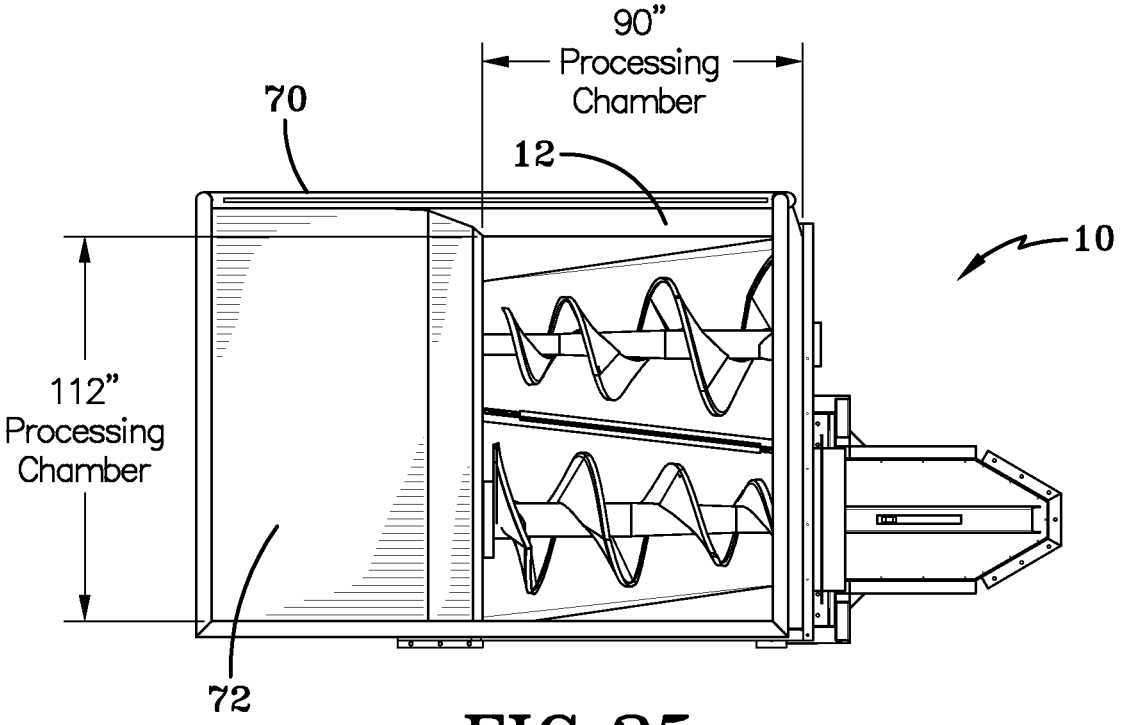
Figure 26:
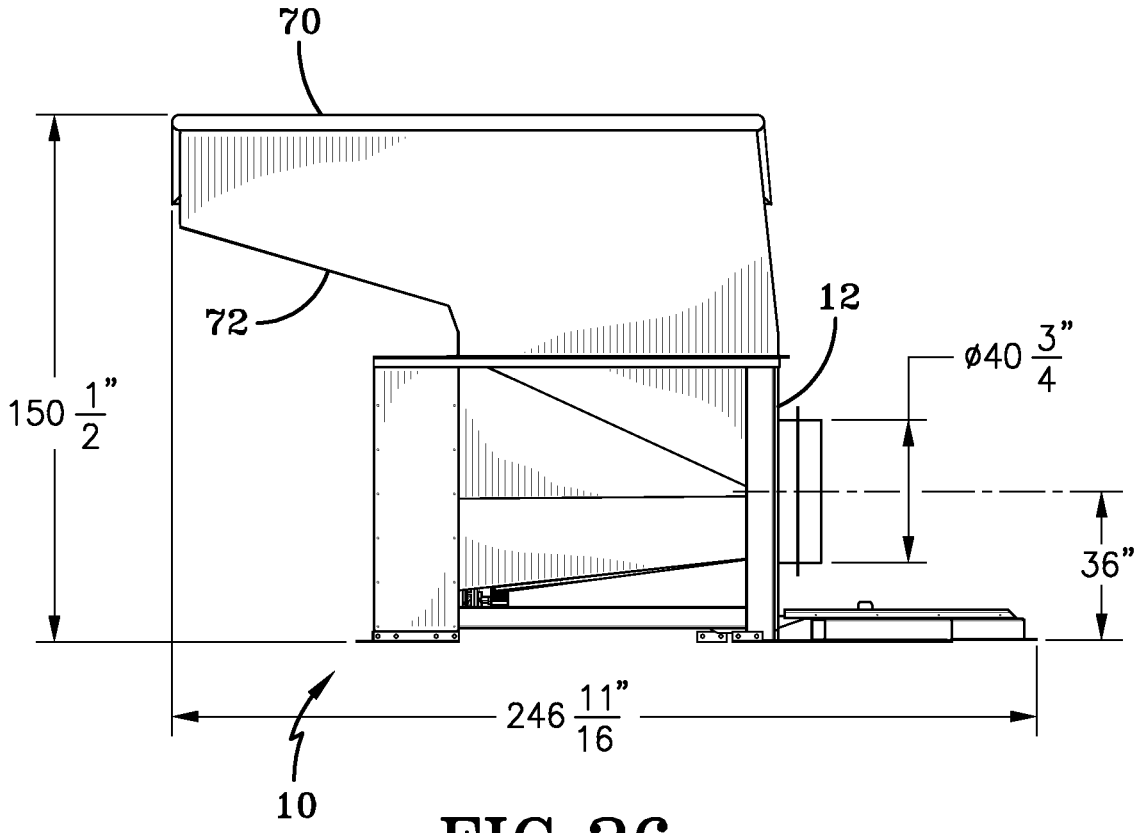
Figure 27:
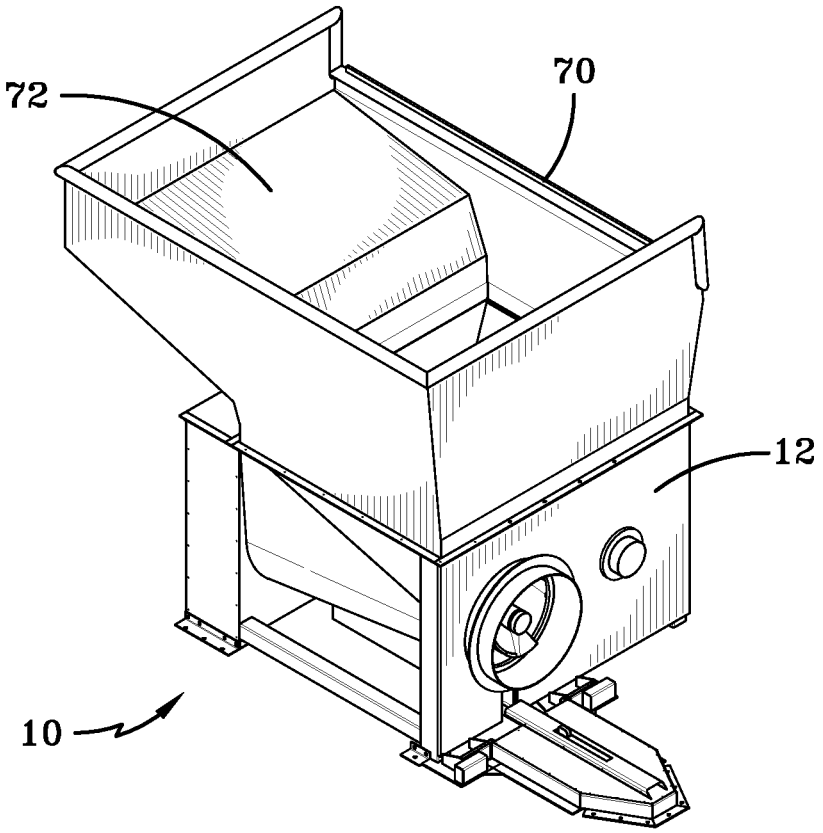
Figure 28:
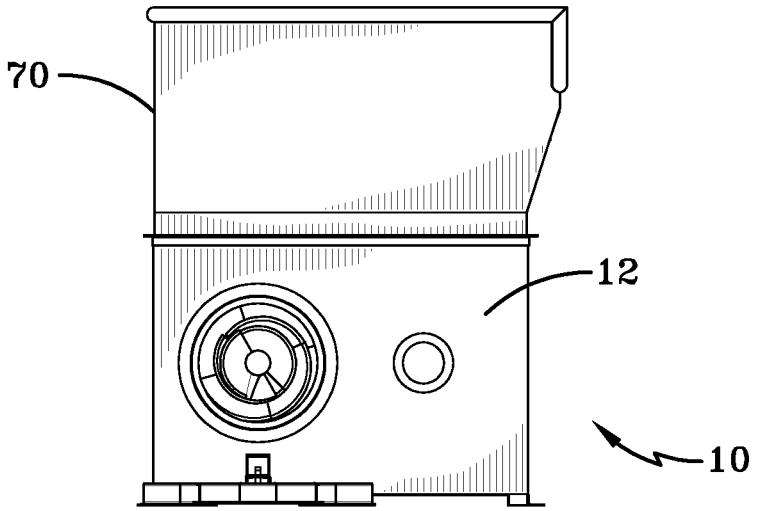
Figure 29:
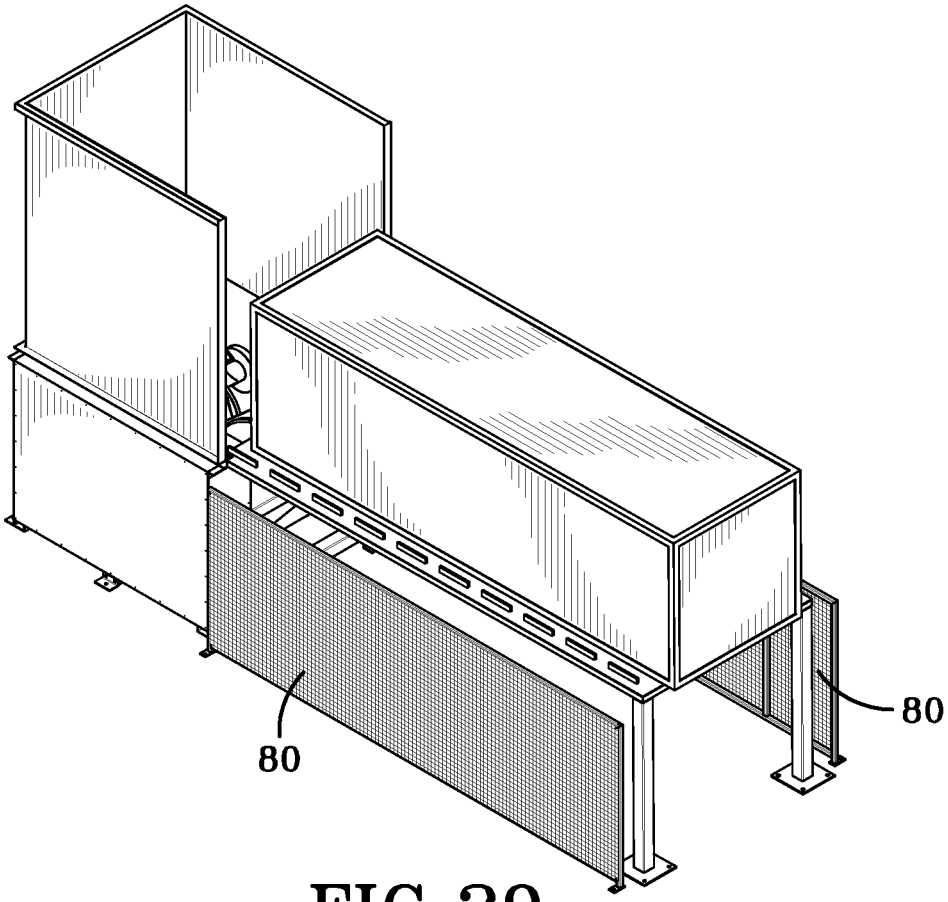
FIGS. 29-34 show various views of a fourth exemplary embodiment of a shredder system of the present invention.
Figure 30:
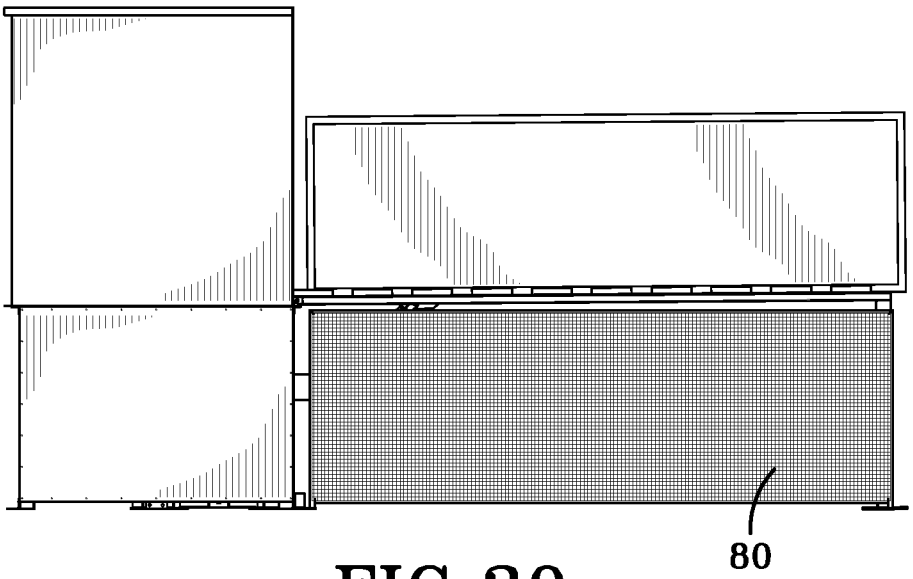
Figure 31:
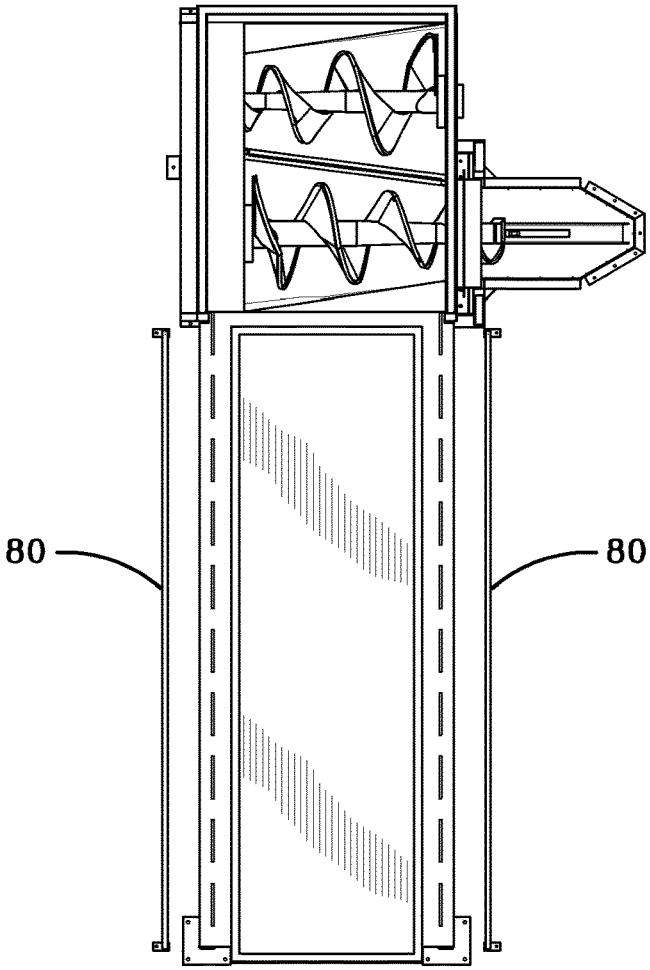
Figure 32:
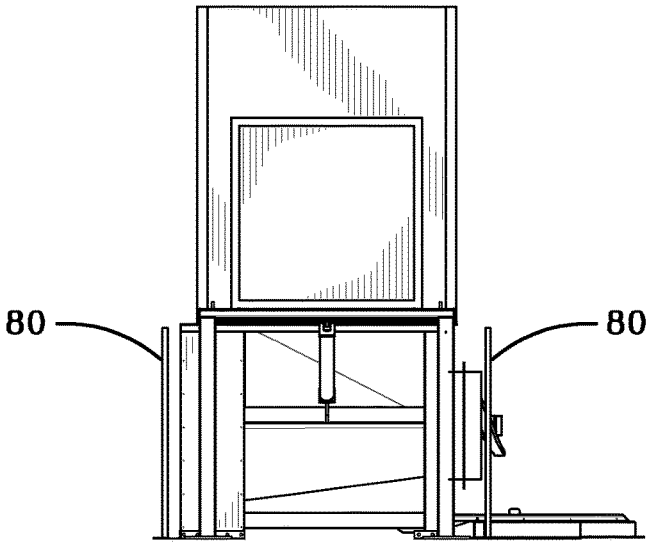
Figure 33:
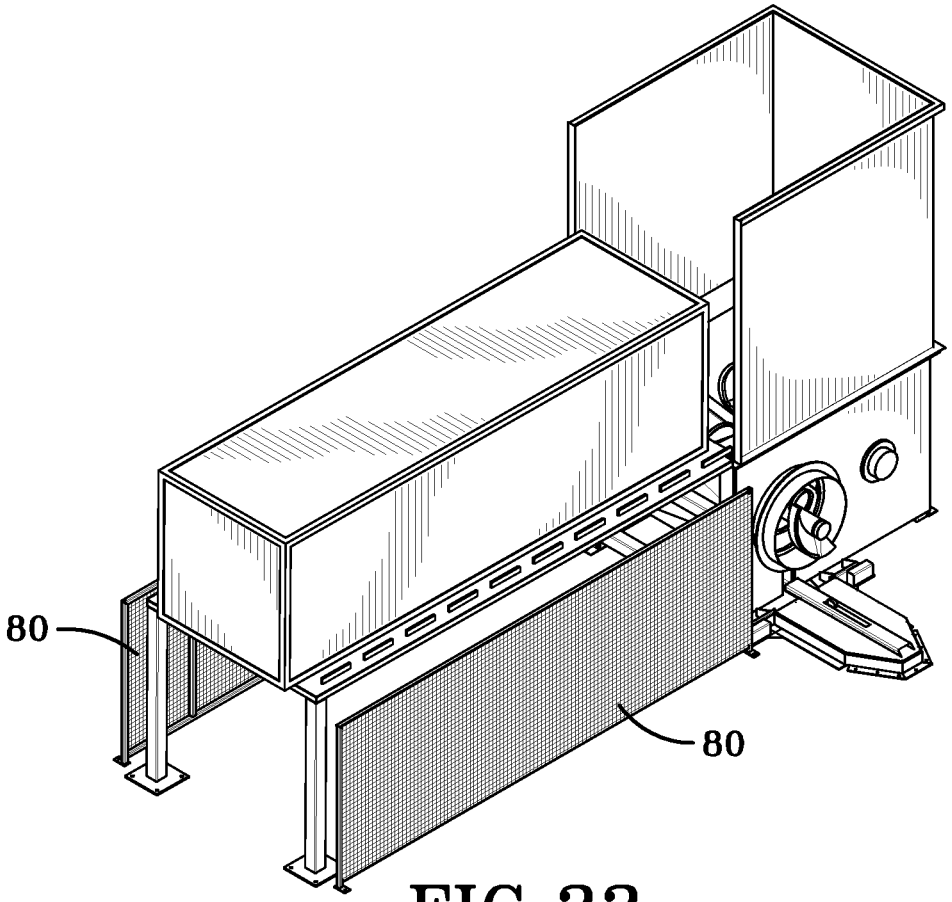
Figure 34:
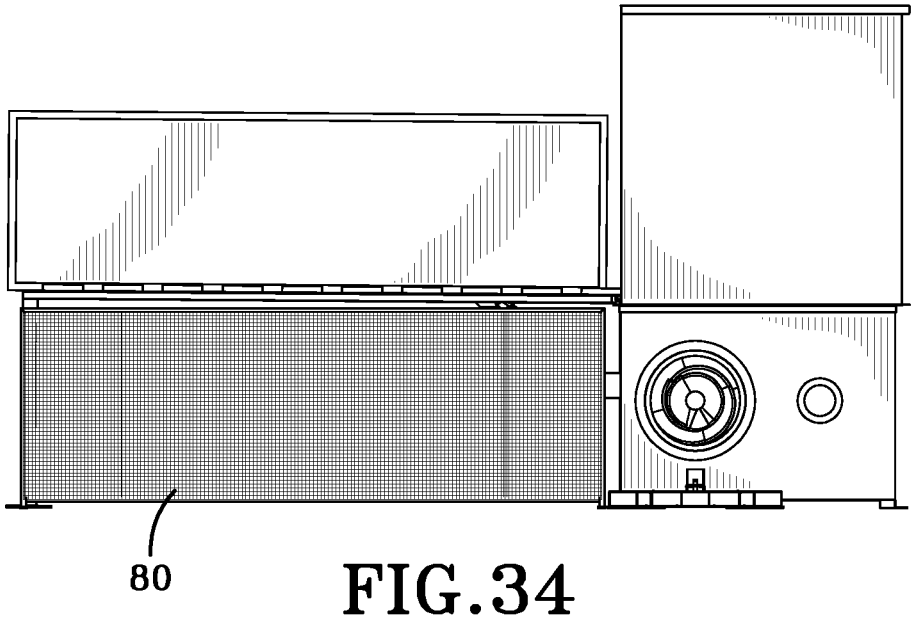
Figure 35:
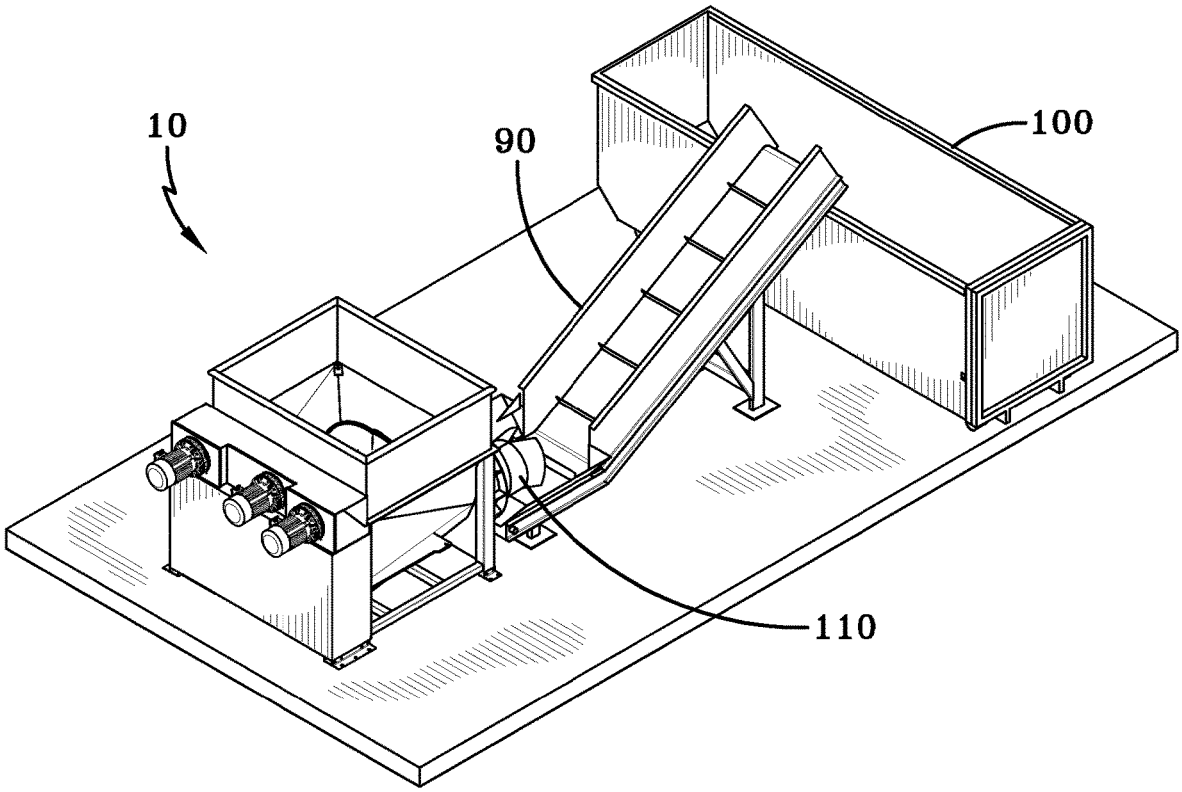
FIGS. 35-40 show various views of a fifth exemplary embodiment of a shredder system of the present invention.
Figure 36:
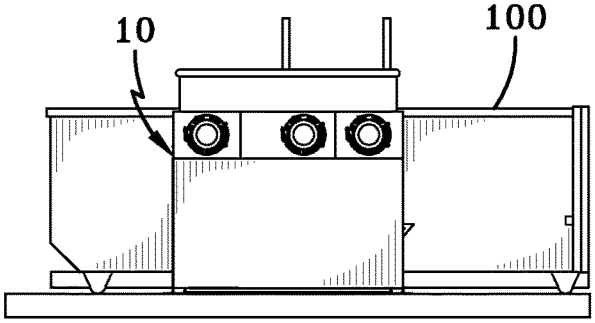
Figure 37:
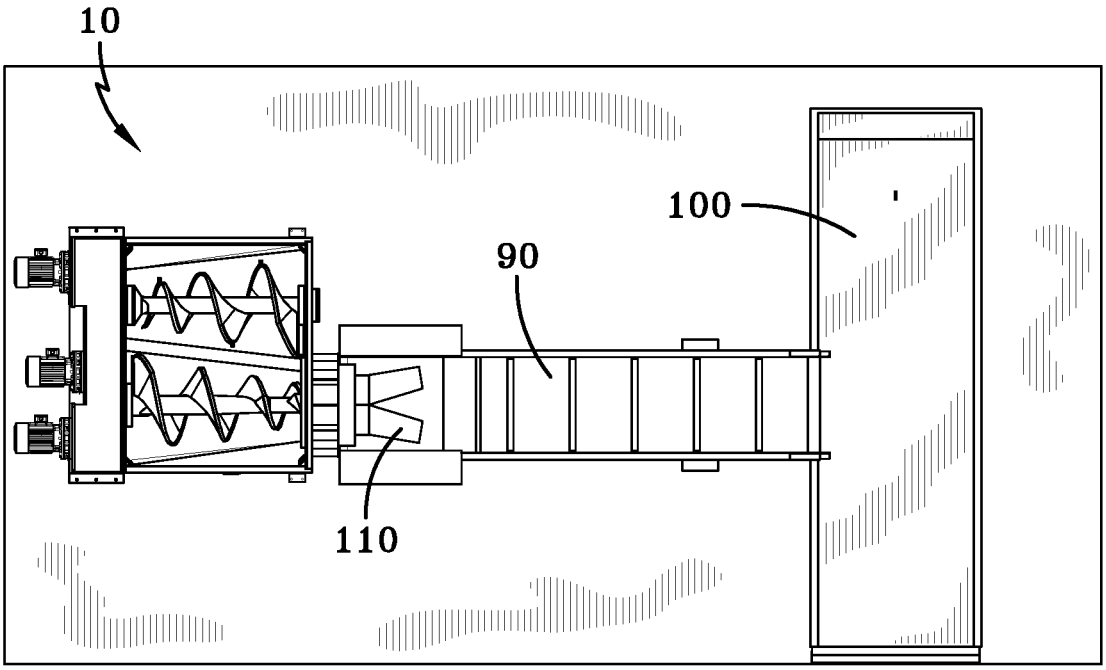
Figure 38:
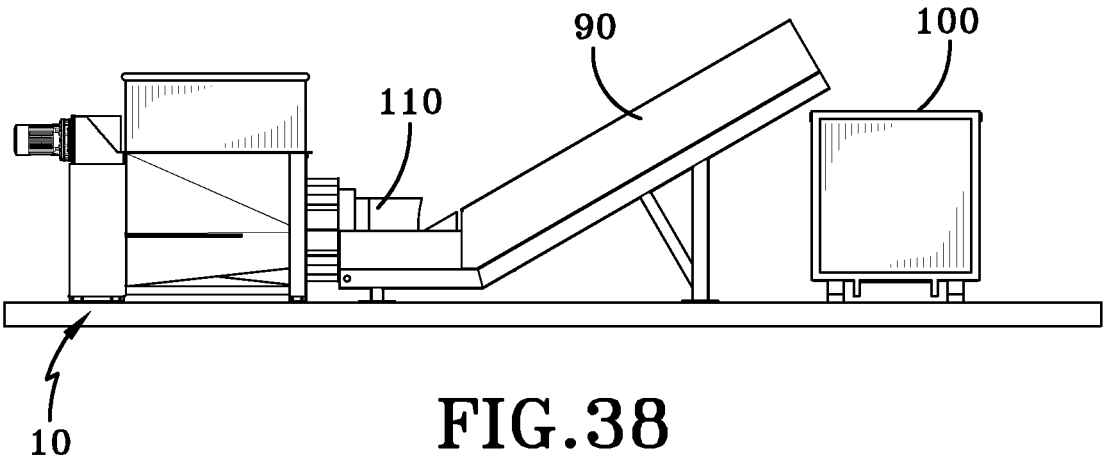
Figure 39:
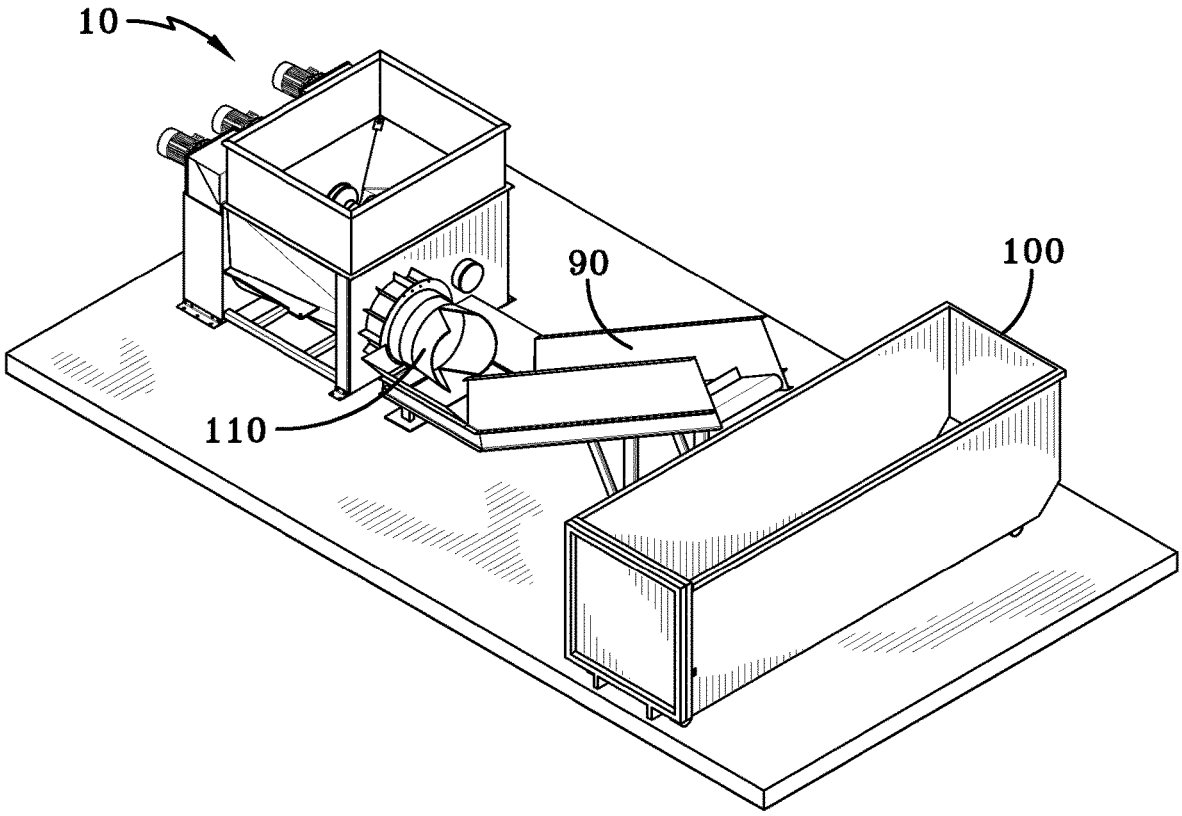
Figure 40:
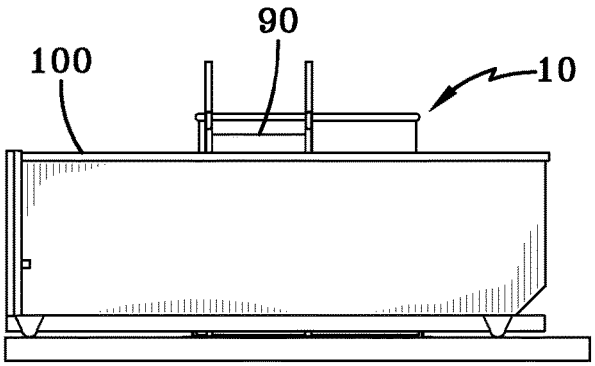
Figure 41:
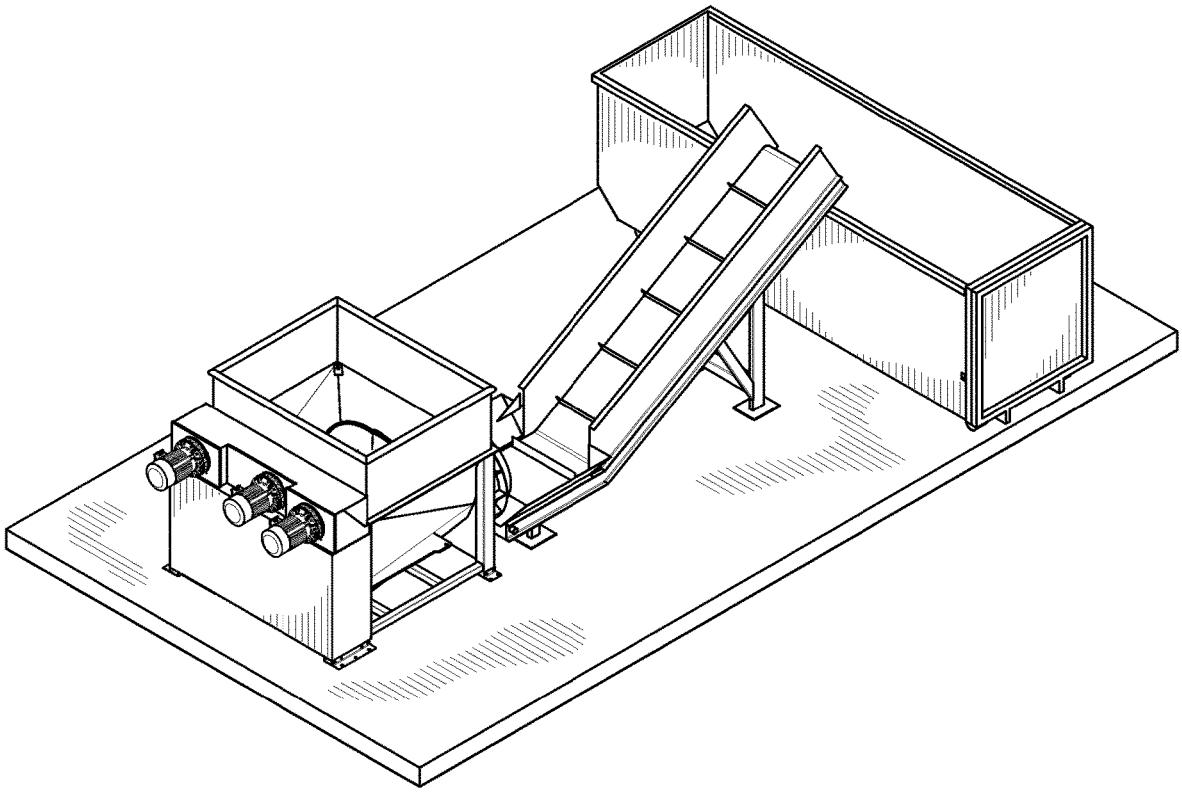
FIGS. 41-46 show various views of a sixth exemplary embodiment of a shredder system of the present invention.
Figure 42:
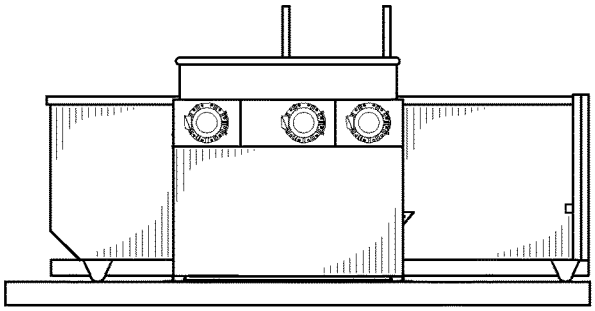
Figure 43:
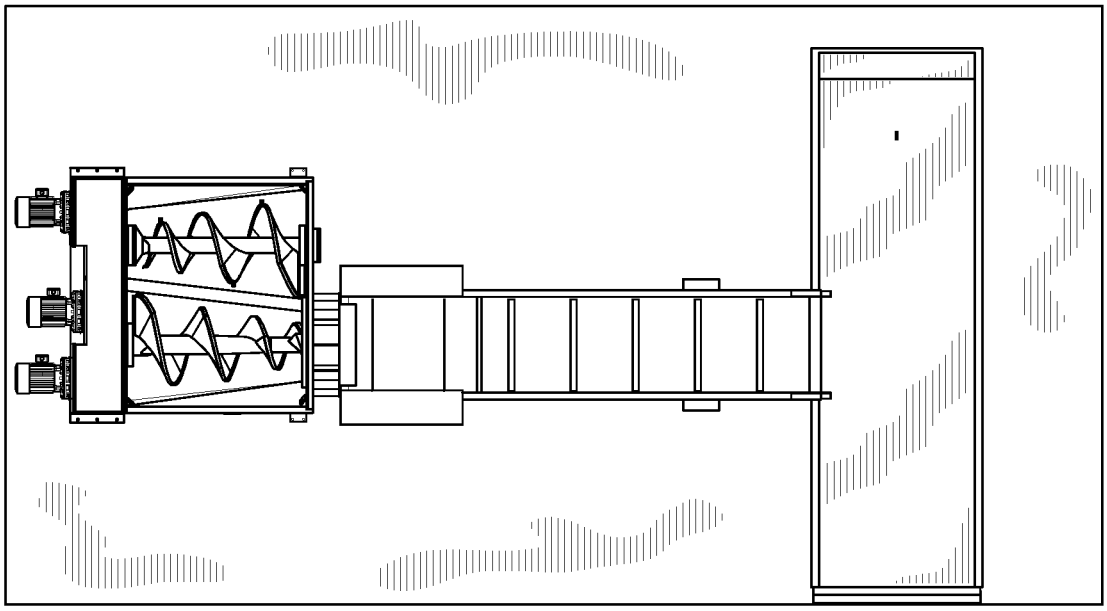
Figure 44:
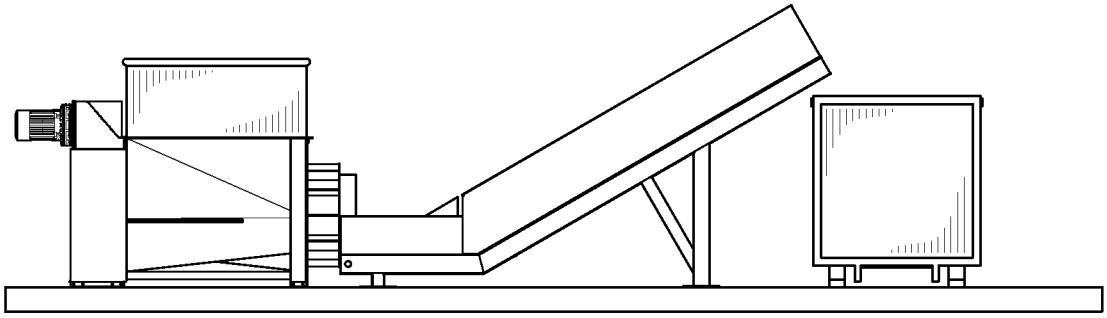
Figure 45:
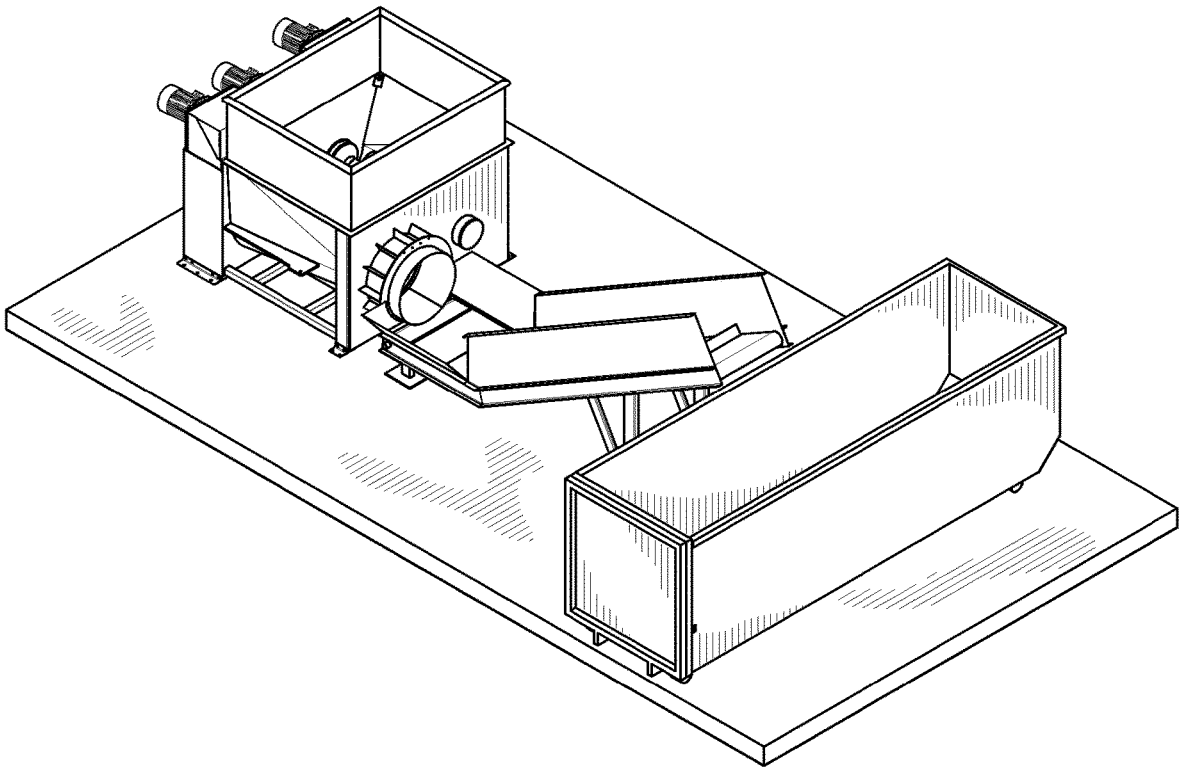
Figure 46:
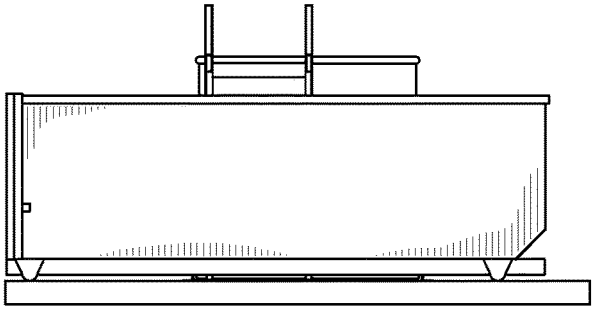
Figure 47:
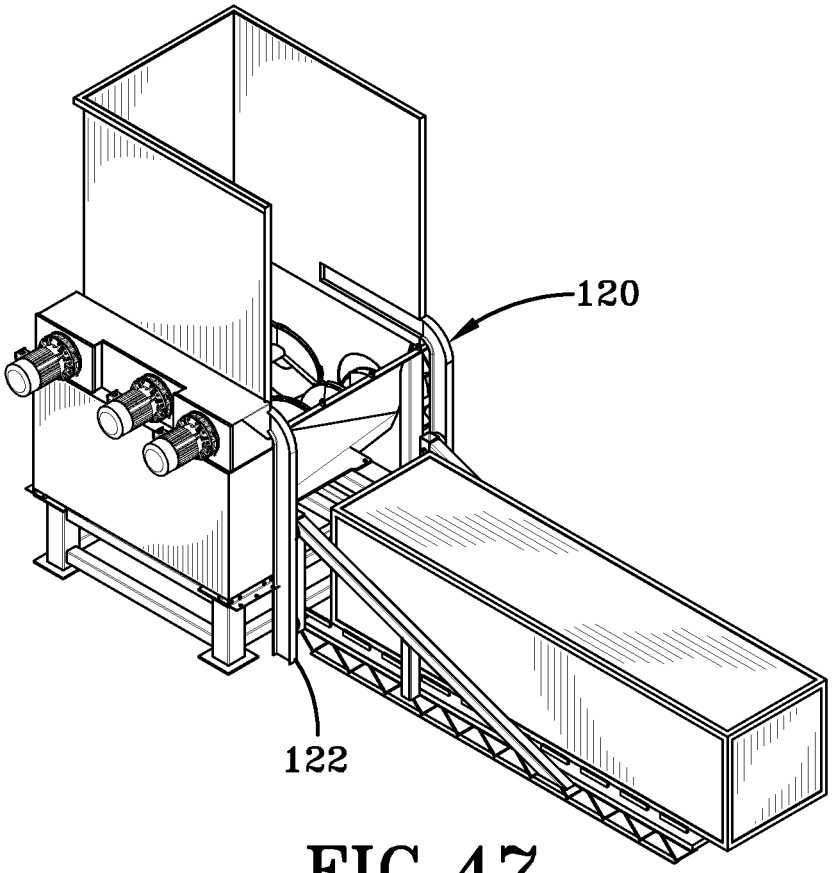
FIGS. 47-52 show various views of a seventh exemplary embodiment of a shredder system of the present invention.
Figure 48:
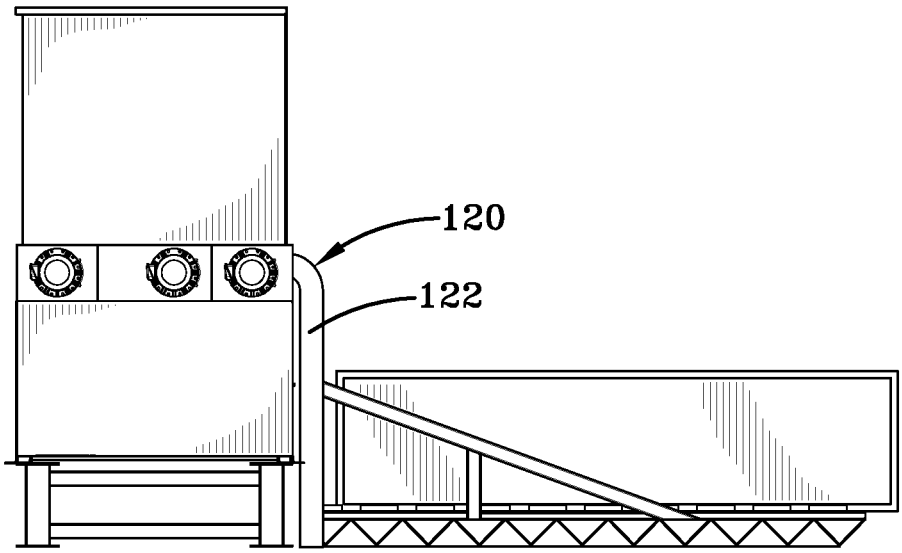
Figure 49:
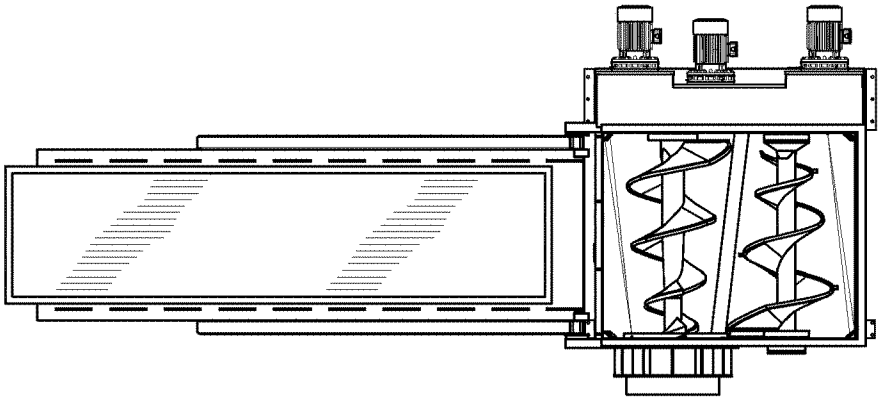
Figure 50:
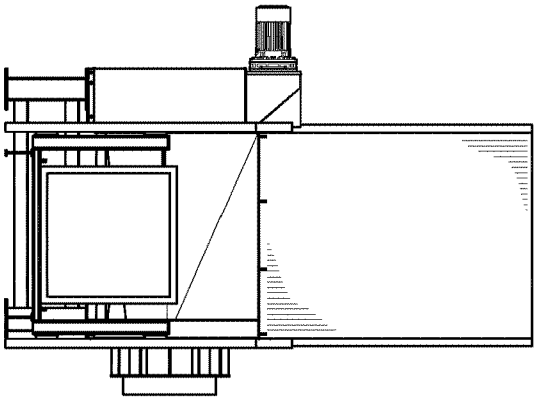
Figure 51:
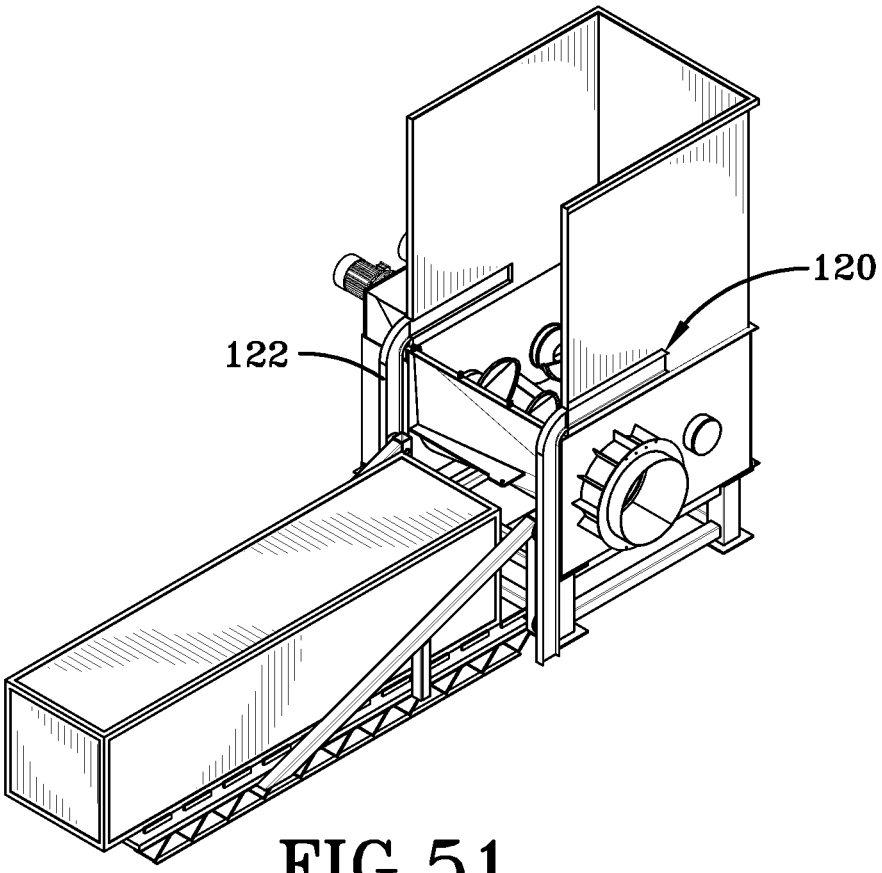
Figure 52:
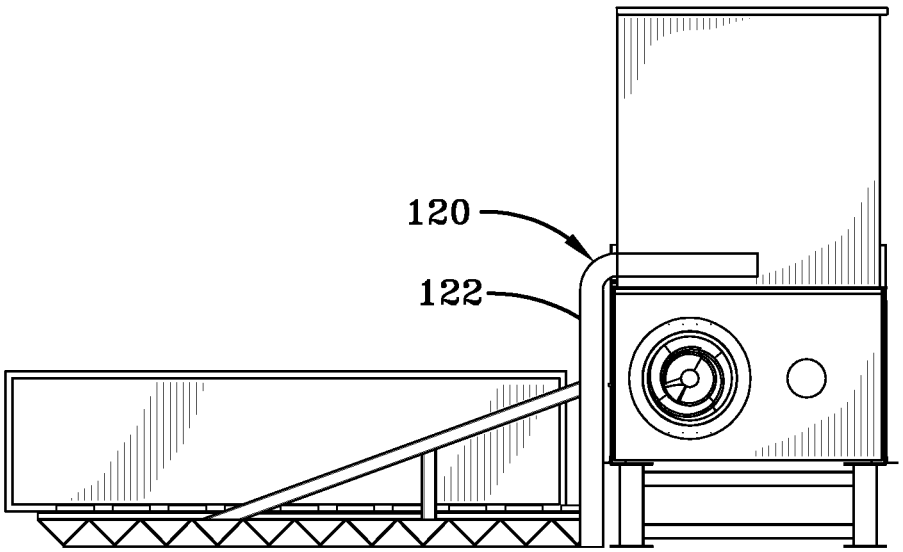
Figure 53:
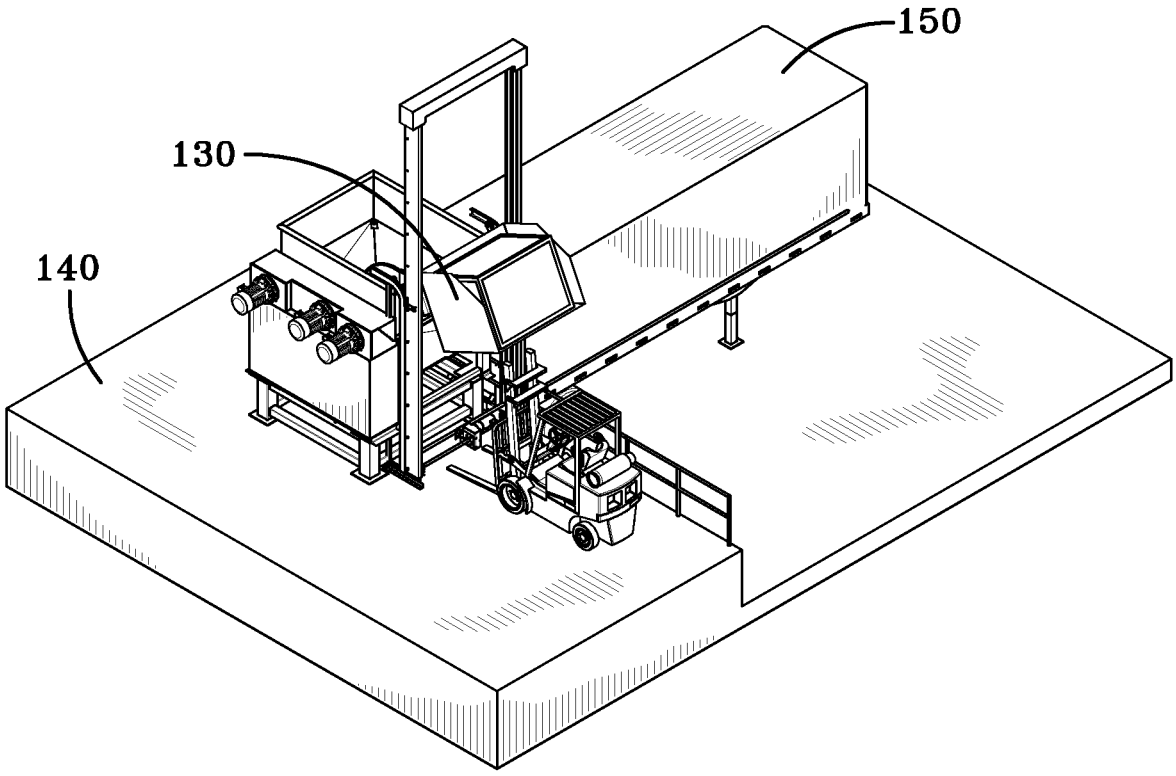
FIGS. 53-58 show various views of an eighth exemplary embodiment of a shredder system of the present invention.
Figure 54:
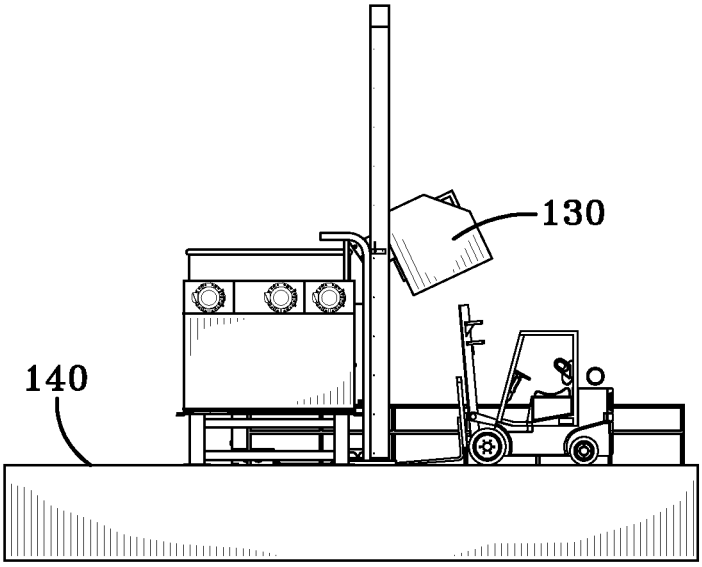
Figure 55:
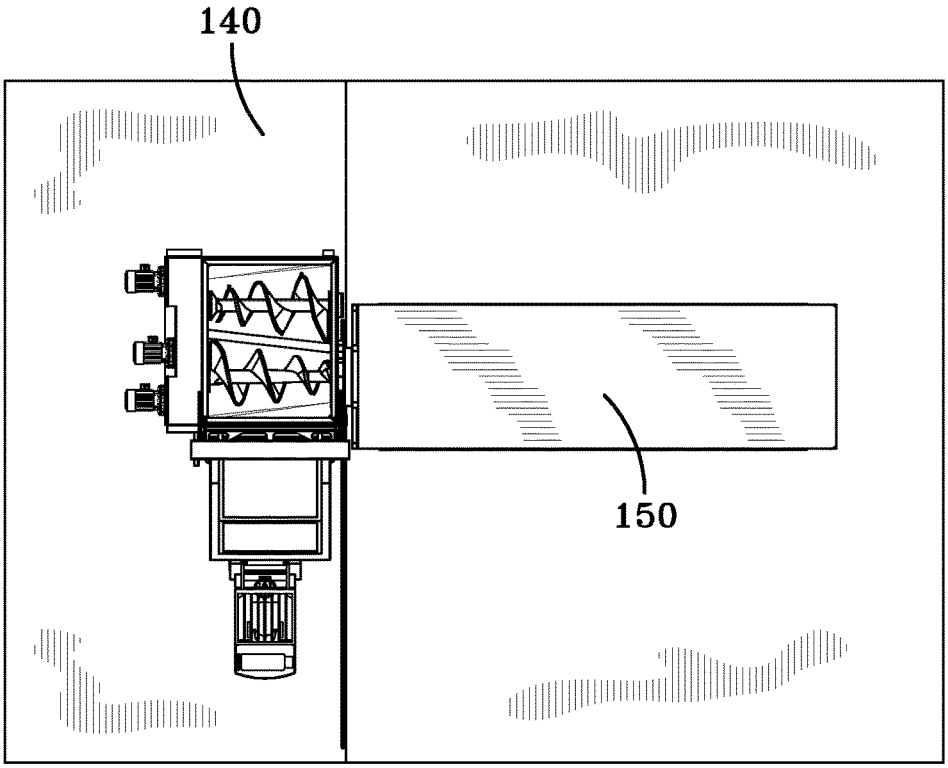
Figure 56:
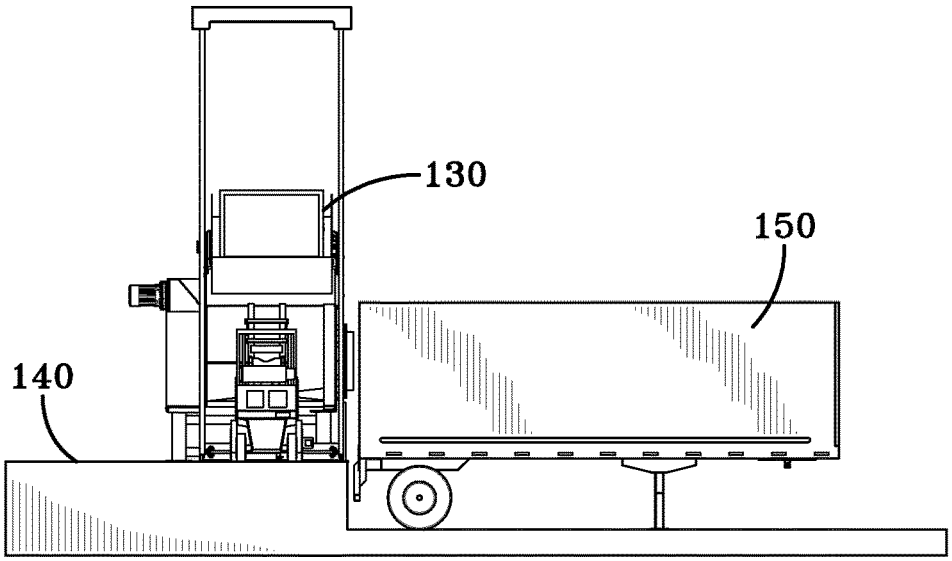
Figure 57:
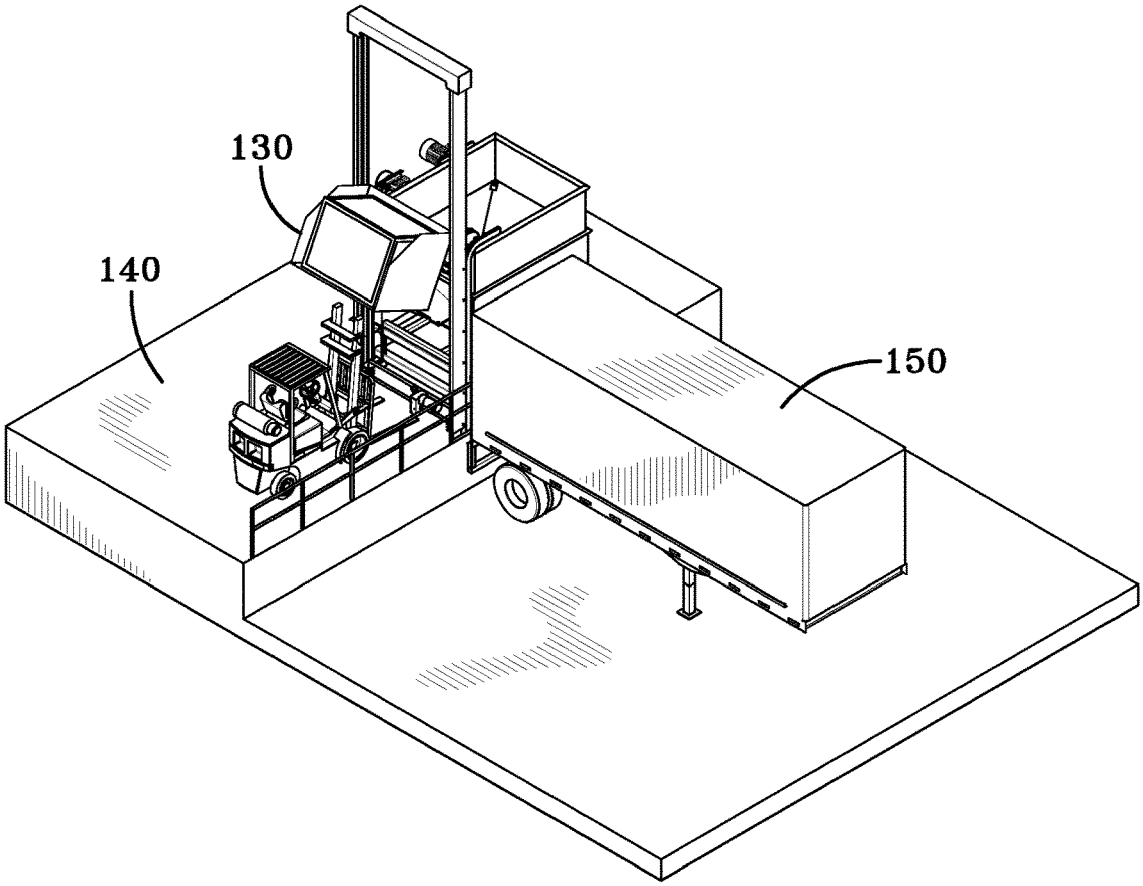
Figure 58:
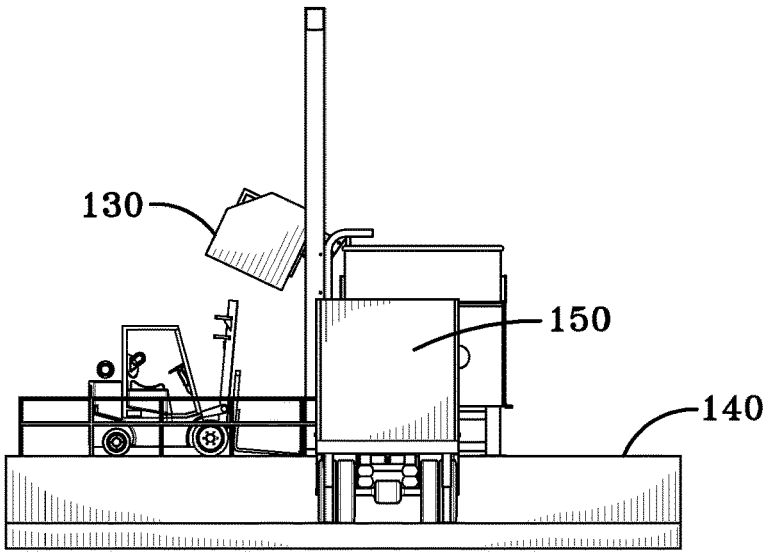
Figure 59:
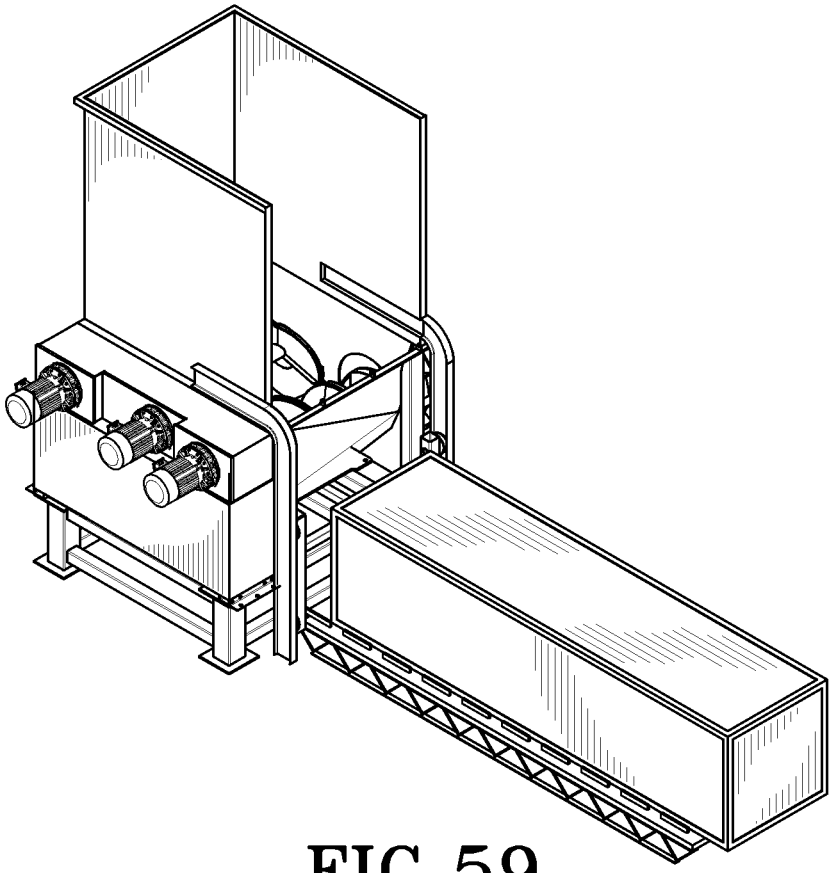
FIGS. 59-64 show various views of a ninth exemplary embodiment of a shredder system of the present invention.
Figure 60:
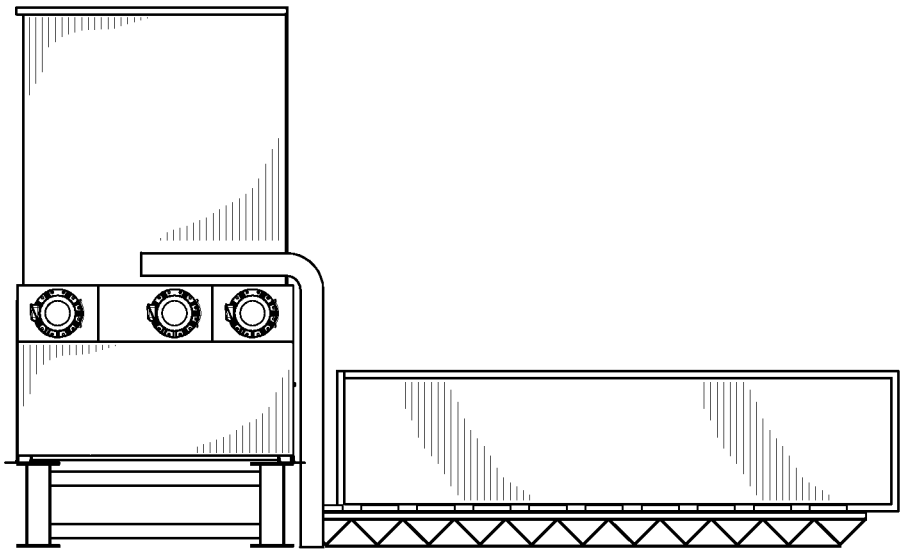
Figure 61:
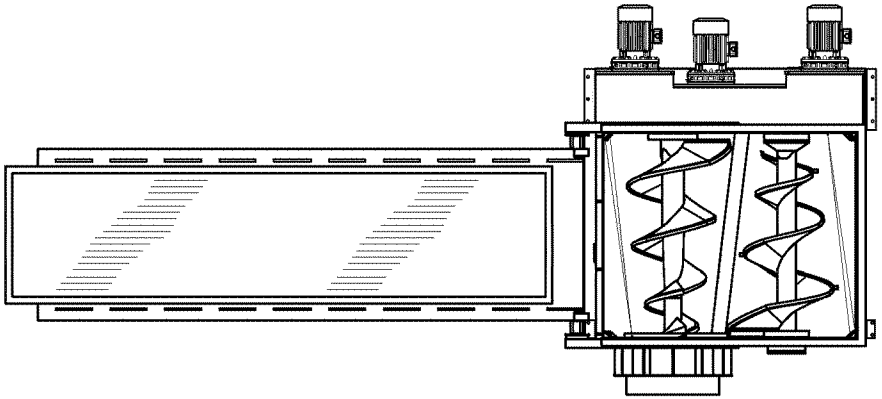
Figure 62:
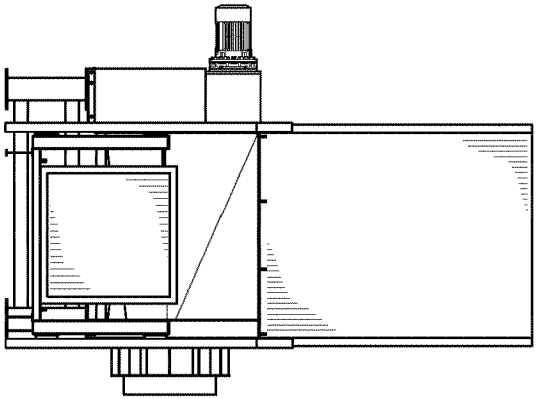
Figure 63:
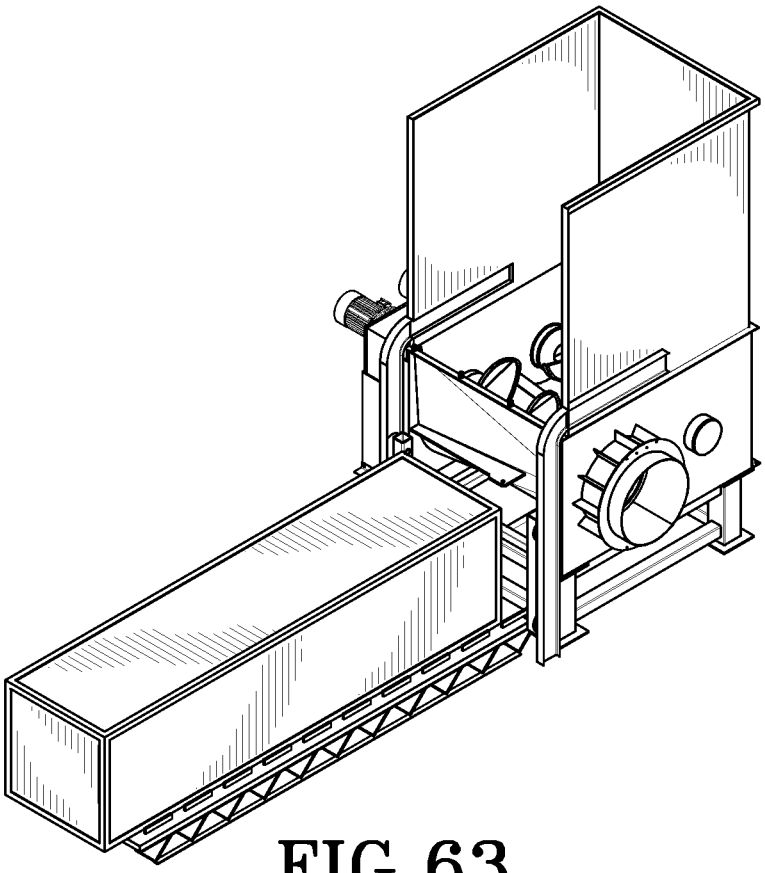
Figure 64:
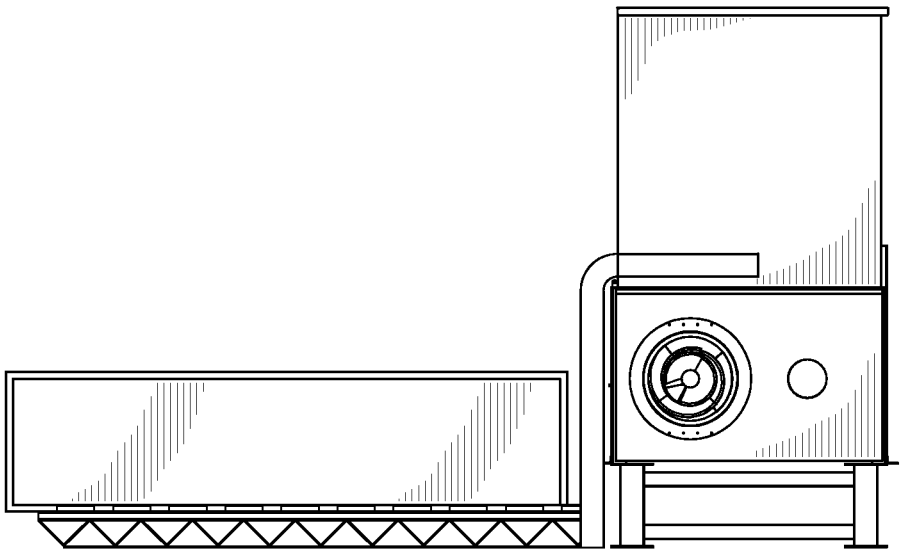

In this exemplary embodiment, discharge opening 20 may be aligned with an axis of cantilevered auger 16, such as shown in the example of FIG. 6. More particularly, in an exemplary embodiment, a center of opening 20 may also be adapted to be aligned with an input opening of a standard roll-off container or semi-trailer. FIGS. 10-15 show an example of system 10 connected or otherwise associated with a standard roll-off container 40 such that shredded material is adapted to be packed into standard roll-off container 40. Alternatively, opening 20 may be adapted to discharge shredded material onto a conveyor or another transfer mechanism.

FIGS. 16-21 show an exemplary embodiment of system 10 further comprising a drop hopper wall 50 associated with processing chamber 12. For example, drop hopper wall 50 may provide a low profile means for loading large crates 60, etc. with a fork lift (not shown). In particular, a fork lift operator may be able to load large (e.g., 20 feet long) crates 60 on drop hopper wall 50, which allows for a lower profile for loading. The reduced height also provides the operator an easier and safer means of controlling the loading of heavy, large crates 60, for example. The drop hopper wall 50 facilitates the positioning of crates 60 or other large items to be in correct alignment to be rotated into the processing chamber 12 of an exemplary embodiment of an oversized dual auger processor system 10. An example of drop hopper wall 50 may be, for example, hydraulically or electrically actuated. In particular, in this example, a lift 52 is adapted to lift and rotate the drop hopper wall 50 such that the crate 60 is directed into the processing chamber 12 for shredding. A lock down base 54 may also be connected to the processing chamber 12 such as to stabilize processing chamber 12 during loading and lifting of the material. In addition, to assist with guiding the load into the processing chamber 12, at least one hopper wall 56 may be connected to and extend up from the processing chamber 12 such that the hopper wall extends at least partially around the input opening 18 of the processing chamber 12.

FIGS. 22-28 show another exemplary embodiment of a system that further comprises an elongated hopper 70 that is connected to processing chamber 12. In particular, elongated hopper 70 is adapted to direct material into processing chamber 12 for shredding. Dimensions are provided for an exemplary embodiment. In this example, elongated hopper 70 includes an elongated landing 72 that extends horizontally away from processing chamber 12 to facilitate loading of large scale material. As such, elongated hopper 70 provides another low profile means for loading large scale items into processing chamber 12. For example, the relatively low profile allows a fork lift operator to load large items into elongated hopper 70 in an easier and safer manner compared to known systems.

FIG. 29-34 show an example of a system that is similar to the embodiment shown in FIGS. 16-21. In particular, this embodiment includes at least one partition 80 to cover at least a portion of the area under the drop hopper wall. Partition(s) 80 may be a deterrent to a person inadvertently walking under the drop hopper wall when in use.

FIGS. 35-40 show various views of an exemplary embodiment in which system 10 is adapted to output shredded material onto conveyor 90, which is then adapted to deliver the shredded material to trailer 100. In this example, system 10 further comprises an extended landing or outlet/extrusion tube 110 that is associated with the discharge opening and directs the shredded material onto conveyor 90. FIGS. 41-46 show various views of an exemplary embodiment of a similar system without an extended landing or outlet/extrusion tube 110.

FIGS. 47-52 show various views of an example of a layout of a dual auger processor system similar to system 10, except with the processing chamber slightly elevated to align with an exemplary embodiment of a transfer trailer. This exemplary embodiment provides a means to process the shredded material into a semi transfer trailer, while still offering low loading height by adding a lift 120 to the drop hopper wall. In this example, lift 120 is associated with the processing chamber and may comprise a rail system 122 that may, for example, be hydraulically or electrically actuated. In an exemplary embodiment, rail system 122 is associated and aligned with the processing chamber to bring the wall back into position by lifting and rotating the load into the processing chamber of an exemplary embodiment of an oversized dual auger processor system to be shredded. However, in some exemplary embodiments, a lift and/or a rail system may have other configurations (e.g., that are not as compact).

FIGS. 53-58 show an example of another system that utilizes a lift to load the material into the processing chamber to be shredded. In this embodiment, the lift is associated with a bucket 130, which may, for example, receive the material from a forklift. Such as shown, the lift is adapted to lift and rotate the bucket 130 such that the material is directed into the processing chamber to be shredded. Furthermore, in this example, the system is situated on a raised platform 140, such that it is adapted to output the shredded material into semi-trailer 150.

FIGS. 59-64 show various views of an exemplary embodiment that is similar to the embodiment shown in FIGS. 47-52. In particular, this exemplary embodiment includes a drop hopper wall that does not have side rails. Such an embodiment may facilitate the placement of a large load on the drop hopper wall.

In view of the aforementioned exemplary embodiments, an exemplary embodiment of a dual auger system is adapted to process a crate or other large materials with two tapered auger screws, with one auger operating within the confines of the processing chamber independent of the primary auger, but in cooperation with the primary auger. In one exemplary embodiment, the primary auger is adapted to rotate at a faster rate than the former auger to facilitate a continual discharge of suitably processed material from the processing chamber, while at the same time allowing for further circulation of material in the processing chamber that has not yet been suitably processed. The dual augers grab, compress, and shred the material, reducing the material size so that the primary auger can compress the material through an outlet opening and/or an extrusion tube into, for example, a standard roll-off compaction container. An exemplary embodiment allows large material to be processed in a low speed device with reduced equipment dimensions, providing operator safety with low profile loading, lower noise level, reduced chances of material being expelled from the processing chamber, and ability to use conventional material transport (e.g., semi-trucks).

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain some of the principles of the present invention so that others skilled in the art may practice the invention. Having shown and described exemplary embodiments of the present invention, those skilled in the art will realize that many variations and modifications may be made to the described invention, which will provide the same result and fall within the spirit of the invention. It is the intention, therefore, to limit the invention only as indicated by the scope of the claims.

What is claimed is:

1. A system for shredding, comprising:

a processing chamber comprised of a top, a bottom, and at least one side, said processing chamber further comprising an input opening configured to receive material to be shredded and a side discharge opening located in said at least one side that is configured to output shredded material;

a first tapered auger positioned in said processing chamber such that an axis of said first tapered auger is aligned with said side discharge opening; and a second tapered auger positioned in said processing chamber, said second tapered auger opposing said first tapered auger such that said material is configured to be shredded between said first tapered auger and said second tapered auger;

wherein said first tapered auger is configured to urge said shredded material forward through said side discharge opening; and wherein said to of said processing chamber is configured to be 10 feet or less above ground or floor level such that said side discharge opening is adapted to be aligned with an input opening of a standard roll-off container.

2. The system of claim 1 further comprising:

a first hydraulic drive configured to power said first tapered auger; and a second hydraulic drive configured to power said second tapered auger.

3. The system of claim 2 wherein:

said first hydraulic drive is comprised of a first direct drive hydraulic motor; and said second hydraulic drive is comprised of a second direct drive hydraulic motor.

4. The system of claim 1 wherein:

said first tapered auger is configured to be powered by a first variable speed drive; and said second tapered auger is configured to be powered by a second variable speed drive.

5. The system of claim 1 wherein each of said first tapered auger and said second tapered auger is respectively comprised of a tapered shaft.

6. The system of claim 1 wherein each of said first tapered auger and said second tapered auger is respectively comprised of a tapered flight.

7. The system of claim 1 wherein each of said first tapered auger and said second tapered auger is respectively comprised of a tapered shaft and a tapered flight.

8. The system of claim 1 wherein each of said first tapered auger and said second tapered auger is respectively comprised of a flight having at least one tooth that extends from an edge of said flight.

9. The system of claim 1 wherein each of said first tapered auger and said second tapered auger is respectively comprised of a shaft such that said shafts are substantially parallel.

10. The system of claim 1 wherein said top of said processing chamber is configured to be 7.5 feet or less above ground or floor level.

11. The system of claim 1 wherein at least one of a respective rate and a respective direction of rotation of said first tapered auger and said second tapered auger is configured to be adjusted.

12. The system of claim 11 wherein each of said first tapered auger and said second tapered auger is configured to be adjusted with respect to said respective rate and said respective direction of rotation.

13. The system of claim 11 wherein said first tapered auger and said second tapered auger are configured to be independently adjusted with respect to at least one of said respective rate and said respective direction of rotation.

14. The system of claim 13 wherein each of said first tapered auger and said second tapered auger is configured to be independently adjusted with respect to said respective rate and said respective direction of rotation.

15. The system of claim 1 wherein at least one of said first tapered auger and said second tapered auger is configured to change direction of rotation.

16. The system of claim 1 wherein said first tapered auger is configured to rotate at a faster rate than said second tapered auger to facilitate discharge of said shredded material through said side discharge opening.

17. The system of claim 1 wherein each of said first tapered auger and said second tapered auger is configured to alternately rotate in forward and reverse directions to facilitate continual processing of said material substantially without discharge.

18. The system of claim 1 further comprising a hopper connected to said processing chamber, said hopper configured to direct said material to be shredded into said processing chamber.

19. The system of claim 18 wherein said hopper includes an elongated landing that extends horizontally away from said processing chamber to facilitate loading of said material to be shredded into said hopper.

20. The system of claim 1 further comprising a lock down base connected to said processing chamber.

21. The system of claim 1 wherein said side discharge opening is configured to be aligned with an input opening of a standard roll-off container.

22. The system of claim 1 further comprising a drop hopper wall associated with said processing chamber, said drop hopper wall configured to receive said material to be shredded and rotate upward such that said material to be shredded is directed into said processing chamber.

23. The system of claim 22 wherein said drop hopper wall is hydraulically or electrically actuated.

24. The system of claim 22 further comprising at least one partition configured to limit inadvertent travel underneath said drop hopper wall.

25. The system of claim 22 further comprising at least one hopper wall connected to and extending up from said processing chamber such that said at least one hopper wall extends at least partially around said input opening of said processing chamber.

26. The system of claim 1 further comprising at least one hopper wall connected to and extending up from said processing chamber such that said at least one hopper wall extends at least partially around said input opening of said processing chamber.

27. The system of claim 1 further comprising a conveyor configured to receive said shredded material that has been discharged from said processing chamber.

28. The system of claim 27 further comprising an outlet tube associated with said side discharge opening and configured to direct said shredded material onto said conveyor.

29. The system of claim 27 wherein said conveyor is configured to deliver said shredded material to a trailer.

30. The system of claim 1 further comprising a lift associated with said processing chamber, said lift comprising a rail system such that said lift is configured to lift and rotate said material to be shredded into said processing chamber.

31. The system of claim 30 wherein said rail system is aligned with said processing chamber.

32. The system of claim 30 further comprising:

a bucket associated with said lift, said bucket configured to receive said material to be shredded;

wherein said lift is configured to lift and rotate said bucket such that said material to be shredded is directed into said processing chamber.

33. The system of claim 30 further comprising:

a drop hopper wall associated with said lift, said drop hopper wall configured to receive said material to be shredded when in a substantially horizontal position that extends away from said processing chamber;

wherein said lift is configured to lift and rotate said drop hopper wall such that said material to be shredded is directed into said processing chamber.

34. The system of claim 30 further comprising at least one hopper wall connected to and extending up from said processing chamber such that said at least one hopper wall extends at least partially around said input opening of said processing chamber.

35. The system of claim 1 wherein said system is configured to output said shredded material into a semi-trailer.

36. The system of claim 1 wherein said first tapered auger is cantilevered.

* * * * *